US007585036B2

(12) United States Patent
Usui

(10) Patent No.: US 7,585,036 B2
(45) Date of Patent: Sep. 8, 2009

(54) PRINTING METHOD, PRINTING APPARATUS, PRINTING SYSTEM, AND STORAGE MEDIUM

(75) Inventor: Toshiki Usui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 222 days.

(21) Appl. No.: 11/236,607

(22) Filed: Sep. 28, 2005

(65) Prior Publication Data

US 2006/0071980 A1 Apr. 6, 2006

(30) Foreign Application Priority Data

Sep. 28, 2004 (JP) ..... 2004-282641

(51) Int. Cl.
*B41J 29/38* (2006.01)

(52) U.S. Cl. ..... 347/10

(58) Field of Classification Search ..... None
See application file for complete search history.

(56) References Cited

U.S. PATENT DOCUMENTS 4,558,332 A * 12/1985 Takahashi ..... 347/14
5,781,203 A * 7/1998 Uriu et al. ..... 347/9
2003/0122888 A1* 7/2003 Baba et al. ..... 347/19
2003/0160836 A1* 8/2003 Fukano et al. ..... 347/12

FOREIGN PATENT DOCUMENTS

JP 2000-52570 A 2/2000

* cited by examiner

*Primary Examiner*—Matthew Luu
*Assistant Examiner*—Justin Seo
(74) *Attorney, Agent, or Firm*—Sughrue Mion, PLLC

(57) ABSTRACT

A printing method that can suppress drops in voltage due to discharging of piezo elements is achieved. A printing method includes: generating a drive signal for driving a piezo element by selecting, based on print data, either a first original drive signal having a unit signal for defining the start to the end of an operation of causing the piezo element to eject ink by changing a voltage of the piezo element using a first reference voltage as a reference, or a second original drive signal having a unit signal for defining the start to the end of an operation of causing the piezo element to eject ink by changing the voltage of the piezo element using a second reference voltage as a reference; ejecting ink using the piezo element by applying the generated drive signal thereto to charge/discharge the piezo element; and charging the piezo element so that the voltage thereof attains either the first or second reference voltage during a predetermined period during which neither the first nor the second original drive signal is selected.

10 Claims, 18 Drawing Sheets

| address | design values | |
|---|---|---|
| | input DAC value (HEX) | output voltage (V) |
| 0000 | 000 | 1. 40 |
| 0001 | 001 | 1. 44 |
| 0002 | 002 | 1. 48 |
| 0003 | 003 | 1. 52 |
| ⋮ | ⋮ | ⋮ |
| 0510 | 1FE | 21. 8 |
| 0511 | 1FF | 21. 84 |
| 0512 | 200 | 21. 88 |
| 0513 | 201 | 21. 92 |
| 0514 | 202 | 21. 96 |
| ⋮ | ⋮ | ⋮ |
| 1020 | 3FC | 42. 20 |
| 1021 | 3FD | 42. 24 |
| 1022 | 3FE | 42. 28 |
| 1023 | 3FF | 42. 32 |

FIG.8

| | voltage (V) | time (number of clocks) |
|---|---|---|
| between A and B | Vh×0. 4+VL | 4 |
| between B and C | — | 4 |
| between C and D | Vh×0+VL | 2 |
| between D and E | — | 3 |
| between E and F | Vh×1+VL | 3 |
| between F and G | — | 6 |
| between G and H | Vh×0. 4+VL | — |

| | |
|---|---|
| maximum amplitude Vh | 36V |
| minimum voltage VL | 1. 4V |

FIG.10

| address | DAC value |
|---|---|
| 001 | 168 |
| 002 | 168 |
| 003 | 168 |
| 004 | 168 |
| 005 | 10E |
| 006 | 0B4 |
| 007 | 05A |
| 008 | 000 |
| 009 | 000 |
| 010 | 12C |
| 011 | 258 |
| 012 | 384 |
| 013 | 384 |
| 014 | 384 |
| 015 | 32A |
| 016 | 2D0 |
| 017 | 276 |
| 018 | 21C |
| 019 | 1C2 |
| 020 | 168 |
| 021 | 168 |
| 022 | 168 |
| 023 | 168 |
| ⋮ | ⋮ |

FIG.11

| pixel data | | waveform selection patterns | | | | | | selection data |
|---|---|---|---|---|---|---|---|---|
| | | t1 | t2 | t3 | t4 | t5 | t6 | |
| non-formation (00) | A | × | × | × | × | × | × | 000000 |
| | B | × | × | × | × | × | × | 000000 |
| small dot (01) | A | × | × | ○ | × | × | × | 001000 |
| | B | × | × | × | × | × | × | 000000 |
| medium dot (10) | A | × | × | ○ | × | × | × | 001000 |
| | B | × | ○ | × | ○ | × | × | 010100 |
| large dot (11) | A | ○ | × | ○ | × | ○ | × | 101010 |
| | B | × | ○ | × | ○ | × | ○ | 010101 |

| signal type | selection data | | N_CHG | switch operation signals | |
|---|---|---|---|---|---|
| | first | second | | first | second |
| pattern 1 | 0 | 0 | 0 | 0 | 0 |
| pattern 2 | 0 | 0 | 1 | 1 | 0 |
| pattern 3 | 0 | 1 | 0 | 0 | 1 |
| pattern 4 | 0 | 1 | 1 | 0 | 1 |
| pattern 5 | 1 | 0 | 0 | 1 | 0 |
| pattern 6 | 1 | 0 | 1 | 1 | 0 |
| pattern 7 | 1 | 1 | 0 | 1 | 0 |
| pattern 8 | 1 | 1 | 1 | 1 | 0 |

| pixel data | | waveform selection patterns | | | | | | | | | | | | selection data |
|---|---|---|---|---|---|---|---|---|---|---|---|---|---|---|
| | | t1 | | t2 | | t3 | | t4 | | t5 | | t6 | | |
| | | ta1 | tb1 | ta2 | tb2 | ta3 | tb3 | ta4 | tb4 | ta5 | tb5 | ta6 | tb6 | |
| non-formation (00) | A | × | × | × | ○ | × | × | × | ○ | × | × | × | ○ | 000100010001 |
| | B | × | ○ | × | × | × | ○ | × | × | × | ○ | × | × | 010001000100 |
| small dot (01) | A | × | × | × | ○ | ○ | × | × | ○ | × | × | × | ○ | 000110010001 |
| | B | × | ○ | × | × | × | ○ | × | × | × | ○ | × | × | 010001000100 |
| medium dot (10) | A | × | × | × | ○ | ○ | × | × | ○ | × | × | × | ○ | 000110010001 |
| | B | × | ○ | ○ | × | × | ○ | ○ | × | × | ○ | × | × | 011001100100 |
| large dot (11) | A | ○ | × | × | ○ | ○ | × | × | ○ | ○ | × | × | ○ | 100110011001 |
| | B | × | ○ | ○ | × | × | ○ | ○ | × | × | ○ | ○ | × | 011001100110 |

Fig.20

PRINTING METHOD, PRINTING APPARATUS, PRINTING SYSTEM, AND STORAGE MEDIUM

CROSS-REFERENCE TO RELATED APPLICATIONS

The present application claims priority upon Japanese Patent Application No. 2004-282641 filed on Sep. 28, 2004, which is herein incorporated by reference.

BACKGROUND OF THE INVENTION

1. Field of the Invention

The present invention relates to printing methods, printing apparatuses, printing systems, and storage media.

2. Description of the Related Art

Some types of printing apparatuses for printing images on media are provided with piezo elements for ejecting ink by being charged and discharged based on a plurality of drive signals. For example, JP 2000-52570A discloses a printing apparatus in which a plurality of types of drive pulses, each corresponding to a different ejection amount of ink, are divided up and included in two original drive signals, and in which printing is performed based on drive signals generated by selecting, from the two original drive signals, the drive pulses to be applied to the piezo elements.

The drive signals for driving the piezo elements are generated based on print data. Thus, the drive signals will be applied to the piezo elements when dots are to be formed in a region of pixels which make up an image, but they will not be applied in cases where dots are not to be formed. Incidentally, the drive signals are provided with drive pulses for ejecting the ink. These drive pulses, for example, raise or lower the voltage of the piezo elements above or below a reference voltage, which serves a predetermined reference, to cause the piezo elements to eject ink. For this reason, the start and the end of each drive pulse are equal to the reference voltage, and thus, the voltage of the piezo elements after ejecting ink becomes equal to the reference voltage. However, if there are contiguous pixels where dots are not formed, then no drive signals are applied to the piezo elements during that time, and thus the piezo elements are discharged and their voltage drops. If a drive signal is applied thereafter for causing dot formation to the piezo elements whose voltage has dropped below the reference voltage, then this will result in a much sharper change in voltage; compared to the ordinary change in voltage that should be caused by the drive signals. Such a sharp change in voltage may result in the piezo elements not operating properly.

SUMMARY OF THE INVENTION

The present invention was arrived at in light of the foregoing issues, and it is an object thereof to achieve a printing method that can suppress the drop in voltage caused by discharging of the piezo elements.

An aspect of the present invention is a printing method comprising the steps of: generating a drive signal for driving a piezo element by selecting, based on print data, either a first original drive signal having a unit signal for defining the start to the end of an operation of causing the piezo element to eject ink by changing a voltage of the piezo element using a first reference voltage as a reference, or a second original drive signal having a unit signal for defining the start to the end of an operation of causing the piezo element to eject ink by changing the voltage of the piezo element using a second reference voltage as a reference; ejecting ink using the piezo element by applying the generated drive signal to the piezo element to charge and discharge the piezo element; and charging the piezo element so that the voltage of the piezo element attains either the first reference voltage or the second reference voltage during a predetermined period during which neither the first original drive signal nor the second original drive signal is selected.

Other features of the present invention will be made clear through the present specification and the accompanying drawings.

BRIEF DESCRIPTION OF THE DRAWINGS

For a more complete understanding of the present invention and the advantages thereof, reference is now made to the following description taken in conjunction with the accompanying drawings.

FIG. 8 is a diagram for illustrating the concept of a DAC value stored in a memory.

FIG. 10 is a diagram for illustrating the concept of information stored in a memory, as information for generating the unit signal shown in FIG. 9.

FIG. 11 is a diagram showing an example of a data table for correlating addresses and DAC values, which are inputted in synchronization with a clock signal CLK for generating a unit signal.

FIG. 20 is a diagram describing waveform selection patterns and selection data in the second embodiment.

DETAILED DESCRIPTION OF THE INVENTION

Figure 1:
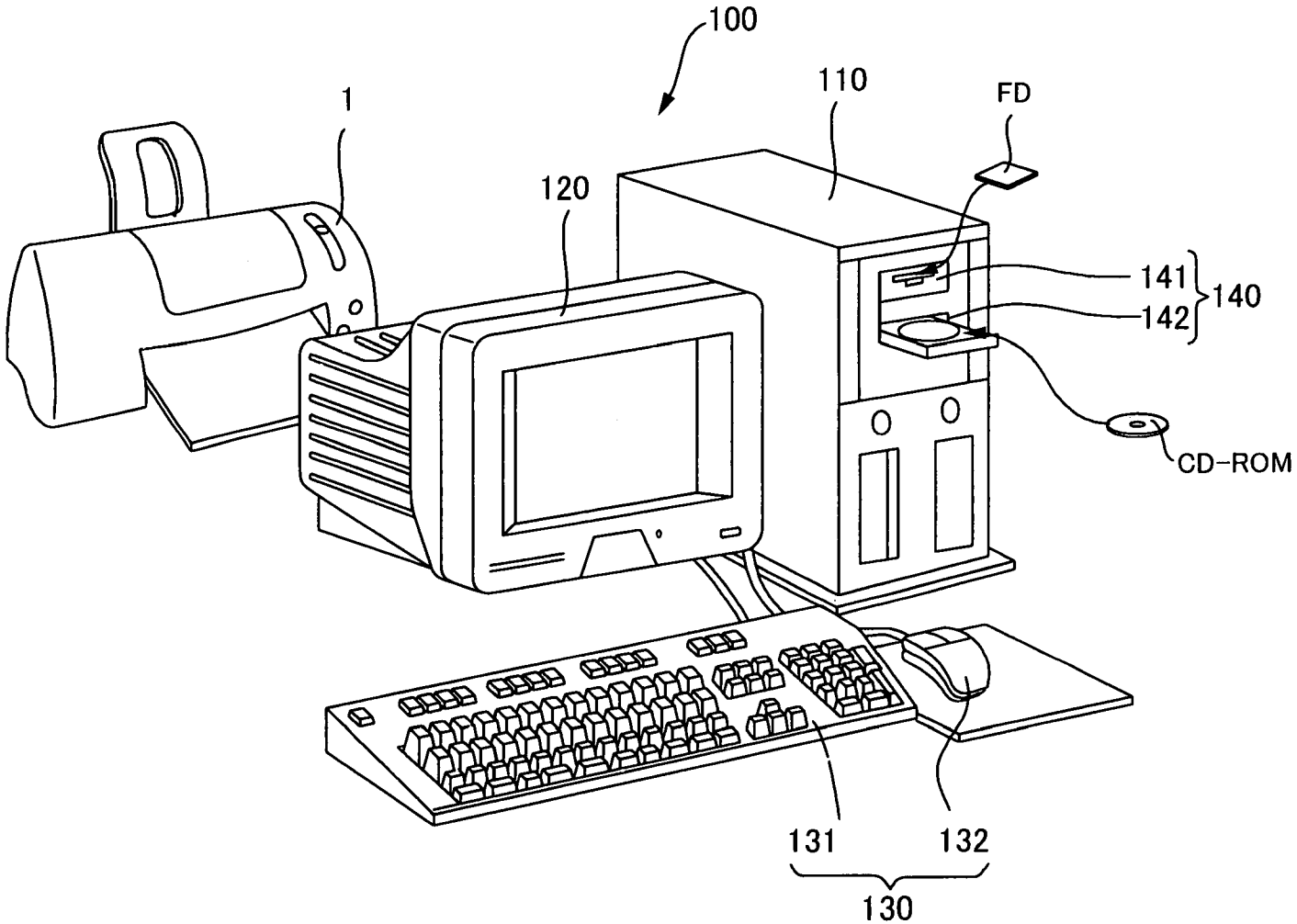
FIG. 1 is diagram describing a configuration of a printing system.

At least the following matters will be made clear by the explanation in the present specification and the description of the accompanying drawings.

An aspect of the present invention is a printing method comprising the steps of: generating a drive signal for driving a piezo element by selecting, based on print data, either a first original drive signal having a unit signal for defining the start to the end of an operation of causing the piezo element to eject ink by changing a voltage of the piezo element using a first reference voltage as a reference, or a second original drive signal having a unit signal for defining the start to the end of an operation of causing the piezo element to eject ink by changing the voltage of the piezo element using a second reference voltage as a reference; ejecting ink using the piezo element by applying the generated drive signal to the piezo element to charge and discharge the piezo element; and charging the piezo element so that the voltage of the piezo element attains either the first reference voltage or the second reference voltage during a predetermined period during which neither the first original drive signal nor the second original drive signal is selected.

During the predetermined period where neither the first original drive signal nor the second original drive signal of the generated drive signal is selected, no voltage is applied to the piezo element. For this reason, during the predetermined time period, the piezo element is discharged and the voltage drops. Incidentally, the unit signal for defining the start to the end of an operation for causing the piezo element to eject ink causes the voltage to change using the first reference voltage or the second reference voltage as a reference. For this reason, the voltage at the starting point of the unit signal is either at the first reference voltage or the second reference voltage. This means that if a unit signal is input after the predetermined time period during which neither the first original drive signal nor the second original drive signal has been selected as the drive signal, a difference in potential will arise at the moment it is input, and the voltage will change suddenly. However, with the present printing method, the piezo elements are charged during the predetermined time period so that the piezo elements attain either the first reference voltage or the second reference voltage, and thus, the piezo elements do not continue being discharged, making it possible to suppress the drop in voltage of the piezo elements. This makes it possible to suppress sudden changes in the voltage of the piezo elements even if the unit signal is input after no ink has been ejected for the predetermined time.

In the above printing method, it is preferable that the predetermined period is a period during which at least either the first original drive signal is equal to the first reference voltage or the second original drive signal is equal to the second reference voltage.

With this kind of printing method, inputting the first original drive signal or the second original drive signal to the piezo element during the predetermined time period makes it possible to charge the piezo element such that the voltage of the piezo element easily attains either the first reference voltage or the second reference voltage.

In the above printing method, it is preferable that the predetermined period is a period during which the first original drive signal is equal to the first reference voltage and the second original drive signal is equal to the second reference voltage.

With this kind of printing method, the predetermined time period is the period during which both the first original drive signal is equal to the first reference voltage and the second original drive signal is equal to the second reference voltage, and therefore, it possible for the voltage of the piezo element to attain either the first reference voltage or the second reference voltage, regardless of which original drive signal is input to the piezo element. It is also possible to make the voltage of the piezo element equal to the first reference voltage or the second reference voltage using the first original drive signal or the second original drive signal, and it is possible to make the voltage of the piezo element equal to either one, depending on the circumstances.

In the above printing method, it is preferable that the piezo element is charged during the predetermined period before the unit signal in the drive signal is output.

With this kind of printing method, the piezo element is charged before the unit signal is input, so when the unit signal is input, the voltage of the piezo element is equal to either the first reference voltage or the second reference voltage. For this reason, the potential of the piezo element does not change suddenly, even if the unit signal is input, making it possible to prevent ink from being ejected at unnecessary positions.

In the above printing method, it is preferable that the piezo element is charged during the predetermined period within a single pixel period during which ink for forming a pixel is ejected, the pixel constituting an image to be printed.

With this kind of printing method, the piezo element is charged during the predetermined time period within the single pixel period, making it possible to shorten the time that passes during which no voltage is applied to the piezo element. This makes it possible to minimize the drop in voltage due to discharging of the piezo element.

In the above printing method, it is preferable that the piezo element is charged during the predetermined period so that the voltage of the piezo element attains the reference voltage of either one of the first original drive signal and the second original drive signal which is to be selected next.

With this printing method, the piezo element is charged so that it attains the reference voltage of whichever of the original drive signals to be selected next, and thus, it becomes possible to minimize the difference between the voltage of the charged piezo element and the voltage when the unit signal to be input begins to be input.

In the above printing method, it is preferable that a plurality of piezo elements are provided; and the piezo elements are charged during the predetermined period according to a charge instruction signal for charging all the piezo elements which can be driven based on the drive signal.

With this kind of printing method, it is possible to charge all the piezo elements using the charge instruction signal, so the process for charging the piezo elements is easy.

In the above printing method, it is preferable that the piezo element is driven based on application information which indicates whether or not to apply either the first original drive signal or the second original drive signal during each set period which has been set; and the piezo element is charged when the application information indicating application of the first original drive signal or the second original drive signal to the piezo element is output during the set period within the predetermined period.

With this kind of printing method, charging of the piezo elements is done based on the application information which indicates whether or not to apply either the first original drive signal or the second original drive signal for driving the piezo elements, making it possible to charge each piezo element in an efficient manner. This can be executed during each set period, thereby making fine control possible.

Another aspect of the present invention is a printing method comprising the steps of: generating a drive signal for driving a piezo element by selecting, based on print data, either a first original drive signal having a unit signal for defining the start to the end of an operation of causing the piezo element to eject ink by changing a voltage of the piezo element using a first reference voltage as a reference, or a second original drive signal having a unit signal for defining the start to the end of an operation of causing the piezo element to eject ink by changing the voltage of the piezo element using a second reference voltage as a reference; ejecting ink using the piezo element by applying the generated drive signal to the piezo element to charge and discharge the piezo element; and charging the piezo element so that the voltage of the piezo element attains either the first reference voltage or the second reference voltage during a predetermined period during which neither the first original drive signal nor the second original drive signal is selected; wherein a plurality of piezo elements are provided as the piezo element; wherein the predetermined period is a period during which the first original drive signal is equal to the first reference voltage and the second original drive signal is equal to the second reference voltage; and wherein the piezo element is charged according to a charge instruction signal for charging all the piezo elements which can be driven based on the drive signal during the predetermined period within a single pixel period during which ink for forming a pixel is ejected, the pixel constituting an image to be printed, before the unit signal in the drive signal is output so that the voltage of the piezo element attains the reference voltage of either one of the first original drive signal and the second original drive signal which is to be selected next.

With this kind of printing method, it is possible to attain almost all of the effects mentioned above, and thus the object of the present invention is achieved most effectively.

It is also possible to achieve a printing apparatus comprising: a piezo element for ejecting ink by being charged and discharged; a drive signal generating section that generates a drive signal for driving the piezo element by selecting, based on print data, either a first original drive signal having a unit signal for defining the start to the end of an operation of causing the piezo element to eject ink by changing a voltage of the piezo element using a first reference voltage as a reference, or a second original drive signal having a unit signal for defining the start to the end of an operation of causing the piezo element to eject ink by changing the voltage of the piezo element using a second reference voltage as a reference; and a controller for charging the piezo element so that the voltage of the piezo element attains either the first reference voltage or the second reference voltage during a predetermined period during which neither the first original drive signal nor the second original drive signal is selected.

It is also possible to achieve a printing system comprising: a computer; and a printing apparatus connected to the computer and having: a piezo element for ejecting ink by being charged and discharged; a drive signal generating section that generates a drive signal for driving the piezo element by selecting, based on print data, either a first original drive signal having a unit signal for defining the start to the end of an operation of causing the piezo element to eject ink by changing a voltage of the piezo element using a first reference voltage as a reference, or a second original drive signal having a unit signal for defining the start to the end of an operation of causing the piezo element to eject ink by changing the voltage of the piezo element using a second reference voltage as a reference; and a controller for charging the piezo element so that the voltage of the piezo element attains either the first reference voltage or the second reference voltage during a predetermined period during which neither the first original drive signal nor the second original drive signal is selected.

It is also possible to achieve a storage medium having recorded thereon a computer program for making a printing apparatus having a piezo element for ejecting ink by being charged and discharged, and a drive signal generating section that generates a drive signal for driving the piezo element by selecting, based on print data, either a first original drive signal having a unit signal for defining the start to the end of an operation of causing the piezo element to eject ink by changing a voltage of the piezo element using a first reference voltage as a reference, or a second original drive signal having a unit signal for defining the start to the end of an operation of causing the piezo element to eject ink by changing the voltage of the piezo element using a second reference voltage as a reference, achieve the function of charging the piezo element so that the voltage of the piezo element attains either the first reference voltage or the second reference voltage during a predetermined period during which neither the first original drive signal nor the second original drive signal is selected.

===Configuration of Printing System===

<Overall Configuration>

First, a printing apparatus will be described together with a printing system. Note that the printing system means a system that includes at least a printing apparatus and a printing control apparatus for controlling operation of the printing apparatus.

FIG. 1 is diagram describing a configuration of the printing system 100. The printing system 100 in the shown example includes a printer 1 as the printing apparatus and a computer 110 as the printing control apparatus. Specifically, the printing system 100 is provided with the printer 1, the computer 110, a display device 120, an input device 130, and a record/play device 140.

The printer 1 prints images on media such as paper, cloth, or film. It should be noted that in the following description, paper S (see FIG. 3A), which is a representative medium, is used as an example of a medium. The computer 110 is communicably connected to the printer 1. In order to cause the printer 1 to print images, the computer 110 outputs print data according to those images to the printer 1. Application programs, printer drivers, and other computer programs are installed in the computer 110. The display device 120 is provided with a display. The display device 120 is, for example, an apparatus for displaying a user interface of the computer program. The input device 130 is, for example, a keyboard 131 and a mouse 132. The record/play device 140 is, for example, a flexible disk drive apparatus 141 or a CD-ROM drive apparatus 142.

===Computer===

<Configuration of the Computer 110>

Figure 2:
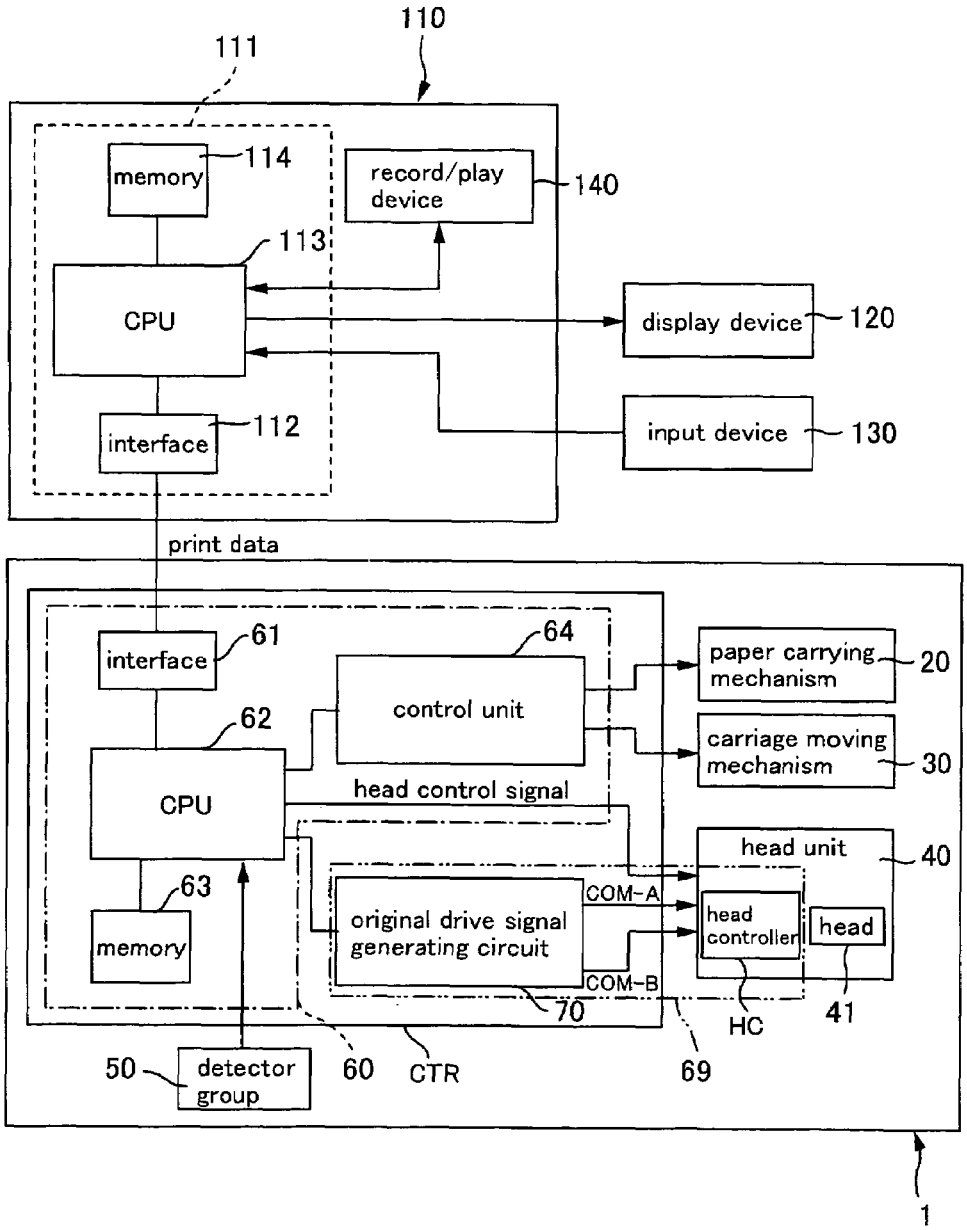
FIG. 2 is a block diagram describing a configuration of a computer and a printer.

FIG. 2 is a block diagram describing a configuration of the computer 110 and the printer 1. First, a simple description of the configuration of the computer 110 is given.

The computer 110 is provided with the above-mentioned record/play device 140 and a host-side controller 111. The record/play device 140 is communicably connected with the host-side controller 111 and is attached to the body of the computer 110, for example. The host-side controller 111 performs a variety of control procedure in the computer 110, and is communicably connected with the above-mentioned display device 120 and the input device 130. The host-side controller 111 is provided with an interface section 112, a CPU 113, and a memory 114. The interface section 112 is interposed between the printer 1 and performs data exchange. The CPU 113 is an arithmetic processing apparatus for carrying out overall control of the computer 110. The memory 114 is for reserving a working area and an area for storing the computer programs for use by the CPU 113, for instance, and is composed of a RAM, an EEPROM, a ROM, or a magnetic disk apparatus, etc. Application programs and printer drivers are, as described above, stored in the memory 114 as computer programs. The CPU 113 performs various control procedures according to the computer programs stored in the memory 114.

The printer driver endows the computer 110 with functionality for converting, into print data, image data which is output from the application programs. The printer 1 executes a printing operation by receiving print data from the computer 110. In other words, the computer 110 controls operation of the printer 1 via the print data. Accordingly, the computer 110 functions as a printing control apparatus using the printer driver. The printer driver is provided with codes for realizing the functionality for converting image data into print data.

The print data is data in formats that can be interpreted by the printer 1, and is provided with a variety of command data and pixel data. Here, "command data" refers to data for instructing the printer 1 to execute a specific operation. This command data includes, for example, command data for instructing to supply paper, command data for indicating a carry amount, and command data for instructing paper discharge. The pixel data is data related to pixels which compose the image to be printed. Here, "pixels" are regions partitioned off into squares in a grid defined virtually on the paper. Dots are formed in the pixels based on pixel data.

The pixel data in the print data is converted into data about the dots (for example, data on the size of the dots) which are formed on the paper. In the present embodiment, the pixel data is composed of two bits of data. In other words, the pixel data includes pixel data "00" which corresponds to no dot, pixel data "01" which corresponds to small dots, pixel data "10" which corresponds to formation of medium dots, and pixel data "11" which corresponds to large dots. Accordingly, the printer 1 can express four gradations according to the dot formation condition for one pixel.

In order to convert the image data that is output from the application program into print data, the printer driver carries out such processes as resolution conversion, color conversion, half toning, and rasterization. The printer driver is provided recorded on a storage medium (computer-readable storage medium) such as a flexible disk FD or CD-ROM, etc. The printer driver can also be downloaded onto the computer 110 via the Internet.

===Printer===

<Configuration of the Printer 1>

Figure 3A:
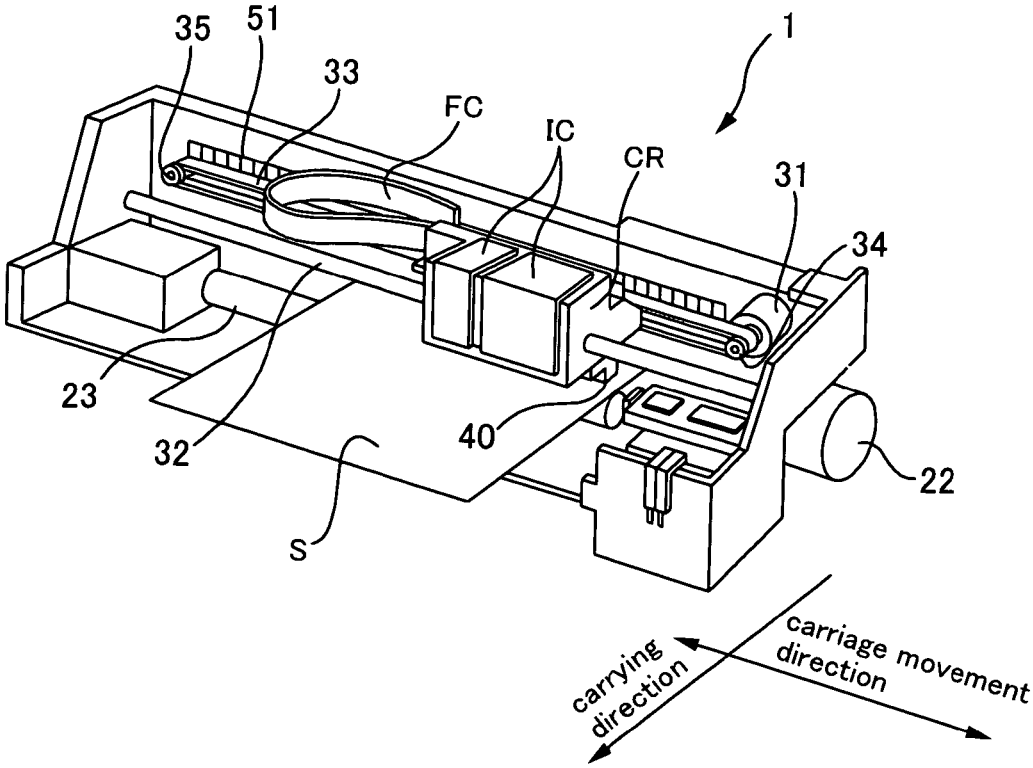
FIG. 3A is a diagram showing a configuration of a printer according to the present embodiment.
Figure 3B:
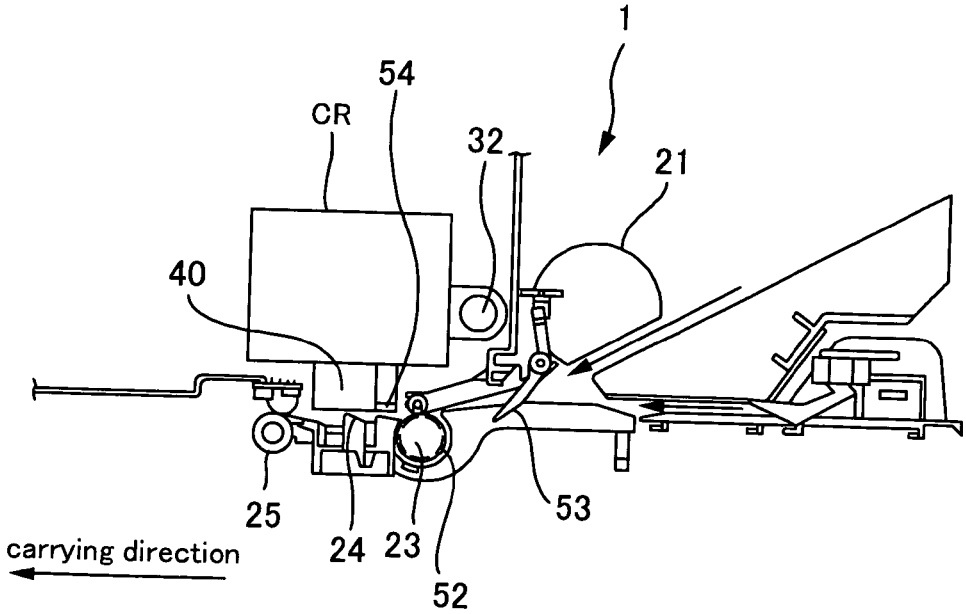
FIG. 3B is a vertical sectional view of an overall configuration of the printer according to this embodiment.

Next follows a description of the configuration of the printer 1. FIG. 3A is a diagram showing a configuration of the printer 1 according to the present embodiment. FIG. 3B is a vertical sectional view for describing an overall configuration of the printer 1 according to this embodiment. The block diagram in FIG. 2 is also referred to in the following description.

As shown in FIG. 2, the printer 1 is provided with a paper carrying mechanism 20, a carriage moving mechanism 30, a head unit 40, a detector group 50, a printer-side controller 60, and an original drive signal generating circuit 70. In the present embodiment, the printer-side controller 60 and the original drive signal generating circuit 70 is provided on a common controller board CTR. The head unit 40 is provided with a head controller HC and a head 41. In this example, the original drive signal generating circuit 70 and the head controller HC are together referred to as the drive signal generating section 69.

In the printer 1, the printer-side controller 60 controls the control targets, i.e., the paper carrying mechanism 20, the carriage moving mechanism 30, the head unit 40 (the head controller HC and the head 41), and the original drive signal generating circuit 70. The printer-side controller 60 thereby causes images to be printed on the paper S based on the print data received from the computer 110. Each detector in the detector group 50 monitors the conditions inside the printer 1. Each detector outputs detection results to the printer-side controller 60. The printer-side controller 60 receives the detection results from the detectors, and controls the control targets based on these detection results.

The paper carrying mechanism 20 corresponds to a "medium carrying section" for carrying a medium. The paper carrying mechanism 20 is for delivering the paper S to a printable position and carrying the paper S by a predetermined carry amount in a carrying direction. The carrying direction is a direction that intersects the carriage movement direction described below. As shown in FIG. 3A and FIG. 3B, the paper carrying mechanism 20 is provided with a paper supply roller 21, a carrying motor 22, a carrying roller 23, a platen 24, and a paper discharge roller 25. The paper supply roller 21 is a roller for automatically sending the paper S, which has been inserted in a paper insert opening, to the printer 1. In this example, it has a cross-sectional shape in the form of the letter "D". The carrying motor 22 is a motor for carrying the paper S in the carrying direction. This operation is controlled by the printer-side controller 60. The carrying roller 23 is a roller for carrying the paper S which has been sent by the paper supply roller 21 to the printable region. The operation of the carrying roller 23 is also controlled by the carrying motor 22. The platen 24 is a member which supports the paper S during printing from the rear surface side thereof. The paper discharge roller 25 is a roller for carrying the paper S, for which printing has finished.

The carriage moving mechanism 30 is for moving a carriage CR which is attached to the head unit 40 in a carriage movement direction. The carriage movement direction includes a movement direction from one side to the other and also a movement direction from the other side back to the one side. Since the head unit 40 is provided with the head 41, the carriage movement direction corresponds to the "movement direction of the head 41" and the carriage moving mechanism 30 corresponds to a "head moving section" which moves the head 41 in the movement direction. The carriage moving mechanism 30 is provided with a carriage motor 31, a guide shaft 32, a timing belt 33, a drive pulley 34, and a driven pulley 35. The carriage motor 31 corresponds to a "drive source" for moving a carriage CR. The operation of the carriage motor 31 is controlled by the printer-side controller 60. The drive pulley 34 is attached to the rotary shaft of the carriage motor 31. The drive pulley 34 is located at one end in the carriage movement direction. The driven pulley 35 is located on the opposite end in the carriage movement direction from the drive pulley 34. The timing belt 33 is connected to the carriage CR and spans the drive pulley 34 and the driven pulley 35. The guide shaft 32 movably supports the carriage CR. The guide shaft 32 is attached in the carriage movement direction. Accordingly, when the carriage motor 31 operates, the carriage CR moves in the carriage movement direction along the guide shaft 32.

Figure 4:
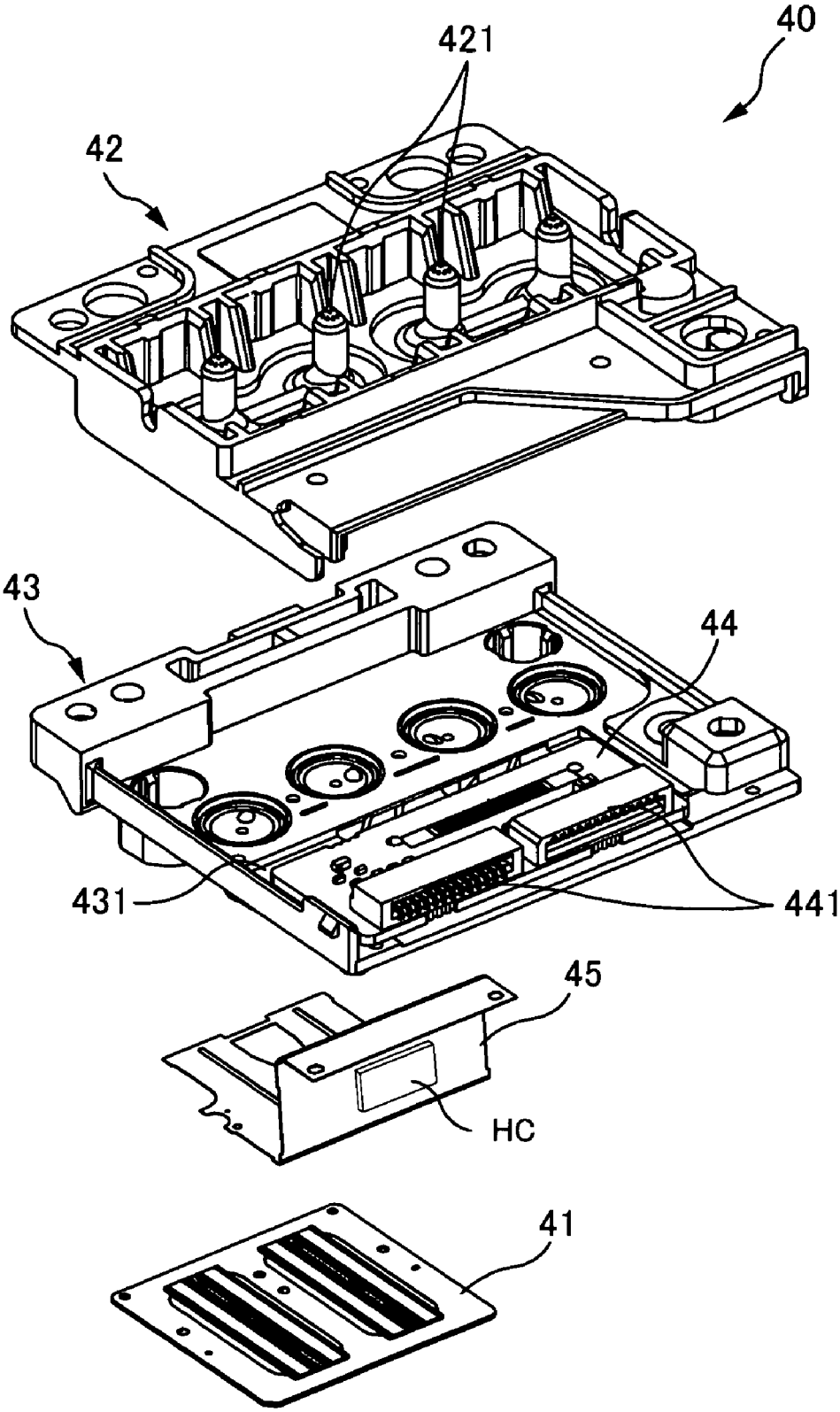
FIG. 4 is an exploded perspective view of a head unit.
Figure 5A:
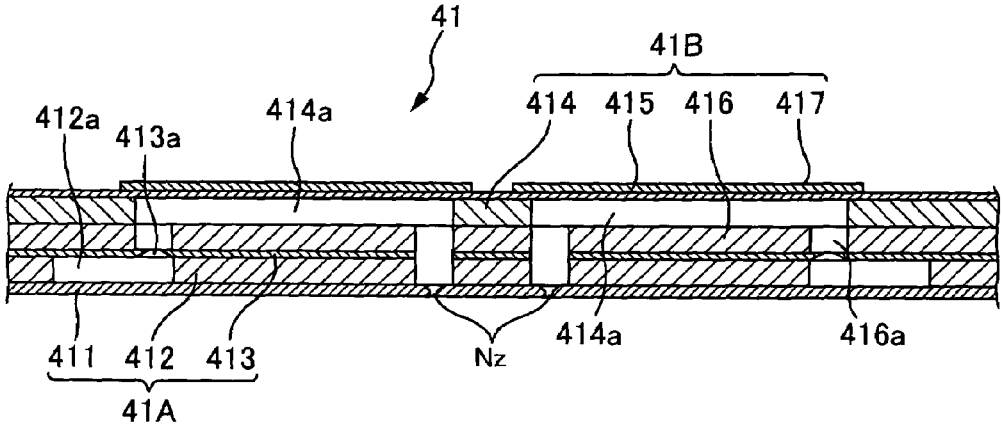
FIG. 5A is cross-sectional view describing the construction of a head.
Figure 5B:
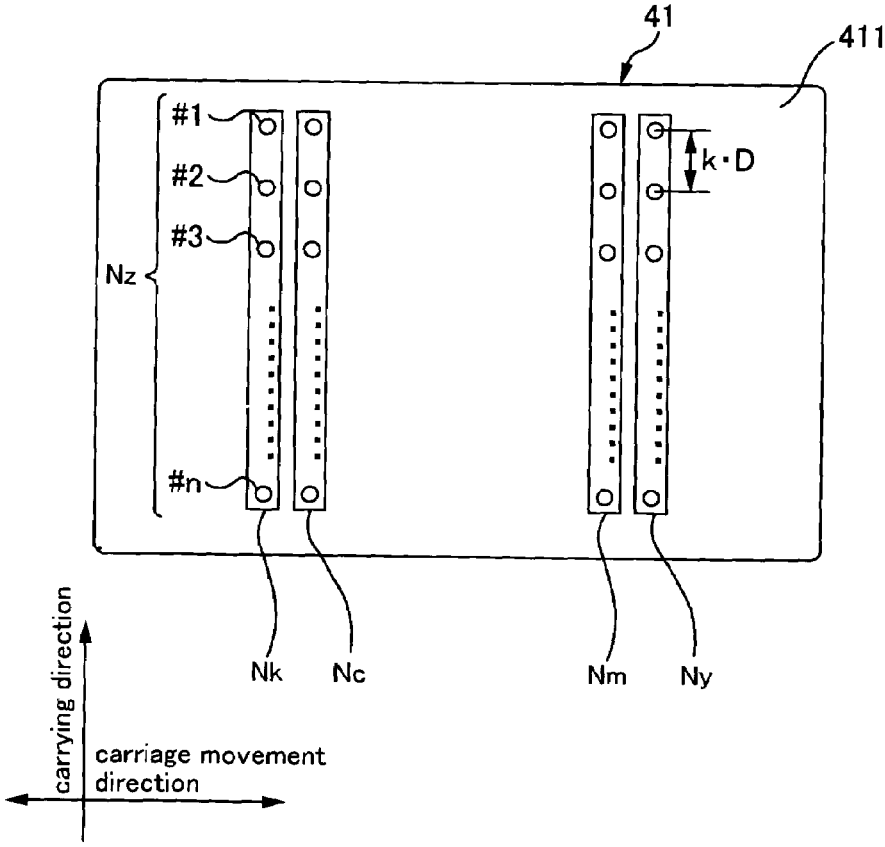
FIG. 5B is a diagram describing an arrangement of nozzles.

The head unit 40 is for ejecting ink toward the paper S. Here, FIG. 4 is an exploded perspective view of the head unit 40. FIG. 5A is a cross-sectional view describing the structure of the head 41. FIG. 5B is a diagram describing an arrangement of nozzles Nz.

The head unit 40 has a structure such as that shown in FIG. 4, for example. In other words, the head unit 40 is provided with the head 41, a needle-side case member 42, and a head-side case member 43. The needle-case member 42 is a member provided with an ink supplying needle 421 which is to be inserted into an ink cartridge IC (see FIG. 3A), and is made by forming plastic, for example. The head-side case member 43 is a member to which is attached the head 41, and is made by forming plastic, for example. The head-side case member 43 is provided with a board arrangement section 431. The board arrangement section 431 is a section on which a head control board 44 is arranged, and is formed by an approximately rectangular recessed portion. The head control board 44 and the head 41 are electrically connected by a film-like head-side wiring member 45. In other words, one side of the head-side wiring member 45 is electrically connected to piezo elements 417 (PZT, see FIG. 5A) on the head 41, while the other side is electrically connected to the head control board 44. The head control board 44 is provided with a head controller HC for controlling the head 41, and a connector 441. The head controller HC will be described below. The head control board 44 and the printer-side controller 60 are electrically connected by a film-like controller-side wiring board FC (see FIG. 3A).

The head 41 which is provided to the head unit 40 has a structure such as that shown in FIG. 5A, for example. The head 41 shown as an example is provided with a flow path unit 41A and an actuator unit 41B. The flow path unit 41A is provided with a nozzle plate 411 in which the nozzles Nz are formed, a storing chamber forming substrate 412 in which opening portions are formed which act as ink storing chambers 412*a*, and a supply port forming substrate 413 in which ink supply ports 413*a* are formed. The nozzle plate 411 adheres to one surface of the storing chamber forming substrate 412, while the supply port forming substrate 413 adheres to the other surface. The actuator unit 41B is provided with a pressure chamber forming substrate 414 in which opening portions which act as pressure chambers 414*a* are formed, a vibration plate 415 which defines a portion of the pressure chambers 414*a*, a lid member 416 in which opening portions which act as supply-side communicating ports 416*a* are formed, and piezo elements 417 which are formed on a surface of the vibration plate 415. A series of flow paths, each leading from the ink storing chamber 412*a* through the pressure chamber 414*a* to the nozzle Nz, is formed in the head 41. When used, the flow paths are filled with ink, and the ink can be caused to be ejected from the corresponding nozzle Nz by causing the piezo elements 417 to be deformed. Accordingly, in the head 41, the piezo elements 417 correspond to elements for causing ink to be ejected.

Furthermore, as shown in FIG. 5B, each nozzle Nz is grouped by the type of ink it ejects, and nozzle rows are composed of each group. The head 41 shown as an example is provided with four nozzle rows made up of a black ink nozzle row Nk, a cyan ink nozzle row Nc, a magenta ink nozzle row Nm, and a yellow nozzle row Ny, and can eject four colors of ink. Each nozzle row is provided with n (in the present embodiment n=180) nozzles Nz. In these nozzle rows, the nozzles Nz are arranged at fixed intervals (nozzle pitch: k·D) in a predetermined arrangement direction (in this example, the carrying direction). Here, D is the minimum dot pitch in the carrying direction, that is, the spacing at the highest resolution of the dots formed on the paper S. On the other hand, k is the coefficient expressing the relationship between the smallest dot pitch D and the nozzle pitch, which is an integer of 1 or larger.

The printer 1, as described above, can perform four types of controls: no dot, corresponding to pixel data "00"; formation of a small dot, which corresponds to pixel data "01"; formation of a medium dot, which corresponds to pixel data "10"; and formation of a large dot, which corresponds to pixel data "11". In this way, it is possible to eject ink of multiple types in differing amounts from the nozzles Nz. For example, it is possible to eject three types of ink from each nozzle Nz: a large ink droplet which can form a large dot; a medium ink droplet which can form a medium dot; and a small ink droplet which can form a small dot. The relationship between the pixel data and the ink which is ejected will be described below.

The detector group 50 is for monitoring the conditions in the printer 1. The detector group 50 includes a linear-type encoder 51, a rotary-type encoder 52, a paper detector 53, a paper width detector 54, and so on. The linear-type encoder 51 is for detecting the position of the carriage CR (the head 41 and the nozzles Nz) in the carriage movement direction. The rotary-type encoder 52 is for detecting the amount of rotation of the carrying roller 23. The paper detector 53 is for detecting the position of the front edge of the paper S to be printed. The paper width detector 54 is a sensor for detecting the width of the paper S to be printed.

The printer-side controller 60 is for controlling the printer 1. The printer-side controller 60 corresponds to a "controller" which applies a drive signal COM to the piezo elements 417. The printer-side controller 60 is, as shown in FIG. 2, provided with an interface section 61, a CPU 62, a memory 63, and a control unit 64. The interface section 61 handles exchange of data with a computer 110, which is an external apparatus. The CPU 62 is an arithmetic processing apparatus for carrying out overall control of the printer 1. The memory 63 is for reserving a working area and an area for storing the programs for the CPU 62, for instance, and is composed of a storage element such as a RAM, an EEPROM, or a ROM. The CPU 62 controls each control target in accordance with computer programs stored in the memory 63. For instance, the CPU 62 controls the paper carrying mechanism 20 and the carriage moving mechanism 30 via the control unit 64. The CPU 62 also outputs, to the head controller HC, head control signals (a clock signal CLK, a pixel data SI, a latch signal LAT, a first change signal CH_A, a second change signal CH_B, and an all-on signal N_CHG; see FIG. 13) for controlling operation of the head 41. The CPU 62 outputs control signals for generating the drive signals COM to the original drive signal generating circuit 70.

Figure 6:
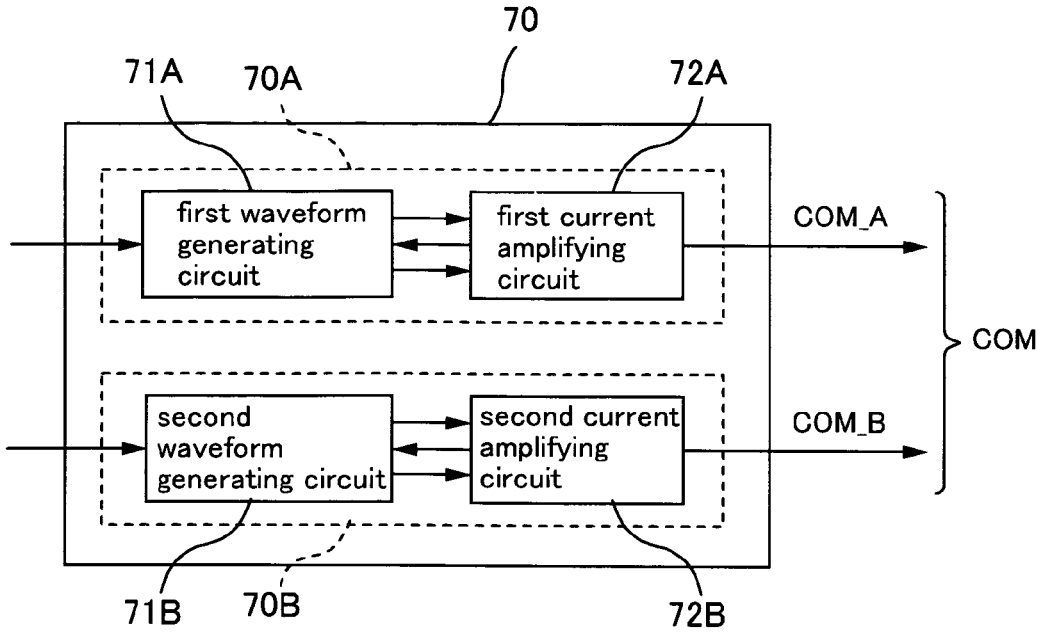
FIG. 6 is a block diagram describing a configuration of an original drive signal generating circuit.

The original drive signal generating circuit 70 generates the drive signals COM which are used in common by each nozzle row. The drive signals COM according the present embodiment are used in common among all the piezo elements 417 provided to one nozzle row. FIG. 6 is a block diagram describing the configuration of the original drive signal generating circuit 70.

The original drive signal generating circuit 70 can generate multiple types of drive signals COM simultaneously. In the present embodiment, an example of the original drive signal generating circuit 70 is described which is provided with two original drive signal generating sections: a first original drive signal generating section 70A which generates a first original drive signal COM_A, and a second original drive signal generating section 70B which generates a second original drive signal COM_B. The first original drive signal generating section 70A is provided with a first waveform generating circuit 71A and a first current amplifying circuit 72A, while the second original drive signal generating section 70B is provided with a second waveform generating circuit 71B and a second current amplifying circuit 72B. Note that the first waveform generating circuit 71A and the second waveform generating circuit 71B have the same configuration, and the first current amplifying circuit 72A and the second current amplifying circuit 72B have the same configuration. For this reason, in the description that follows, only the first waveform generating circuit 71A and the first current amplifying circuit 72A will mainly be described.

Figure 7:
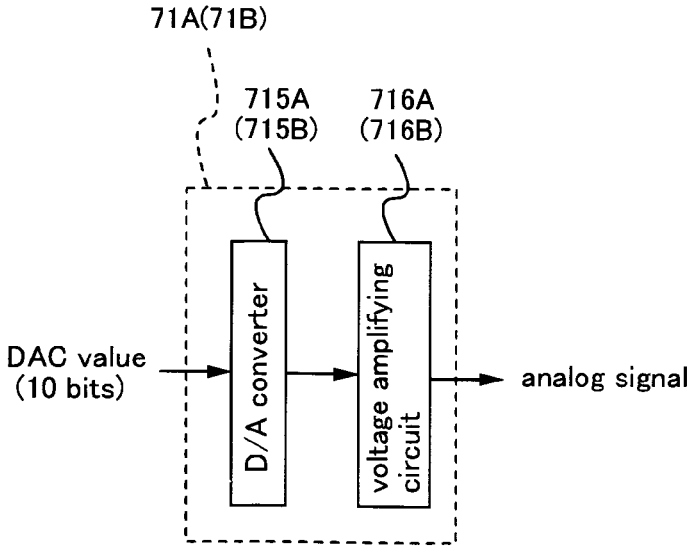
FIG. 7 is a block diagram describing a configuration of a first waveform generating circuit and a second waveform generating circuit.

FIG. 7 is a block diagram describing the configuration of the first waveform generating circuit 71A and the second waveform generating circuit 71B. The configuration of the second waveform generating circuit 71B is indicated by numbers in parentheses. The first waveform generating circuit 71A is provided with a digital-analog converter (D/A converter) 715A and a voltage amplifying circuit 716A.

The digital-analog converter 715A converts DAC-value data which is numerical information periodically input under control by the CPU 62 into an analog signal. The voltage amplifying circuit 716A is connected electrically to an output pin on the digital-analog converter 715A. The voltage amplifying circuit 716A amplifies the voltage of the analog signal output by the digital-analog converter 715A to a voltage at which the piezo elements 417 can operate. In other words, the first waveform generating circuit 71A and the second waveform generating circuit 71B according the present embodiment convert the input DAC value into its corresponding analog signal every time the clock signal CLK of a predetermined time period is input, and amplify the voltage and current of the converted analog signal, to thereby generate the original drive signal. For this reason, the data of many types of DAC value, which are set so that the output voltage changes by a predetermined amount every time the DAC value increases, are stored in corresponding addresses in the memory 63.

FIG. 8 is a diagram for illustrating the concept of a DAC value stored in the memory 63. As shown in the diagram, the DAC value "0h (in hexadecimal notation)" that results in an output voltage equal the minimum value of 1.4 V is stored in address "0000", while the DAC value "3FFh (in hexadecimal notation)" that results in an output voltage equal the maximum value of 42.32 V is stored in address "1023". Below, DAC values will be notated in hexadecimal notation, with an "h" at the end. All the addresses between addresses "0000" and "1023" store, in sequence, DAC values that result in output voltages differing from one another by a predetermined amount (here, 0.04 V). The output voltages shown in FIG. 8 are output voltages that are obtained when a DAC value is input to an ideally designed first original drive signal generating section 70A and second original drive signal generating section 70B, but those output voltages may not be achieved in actuality.

Figure 9:
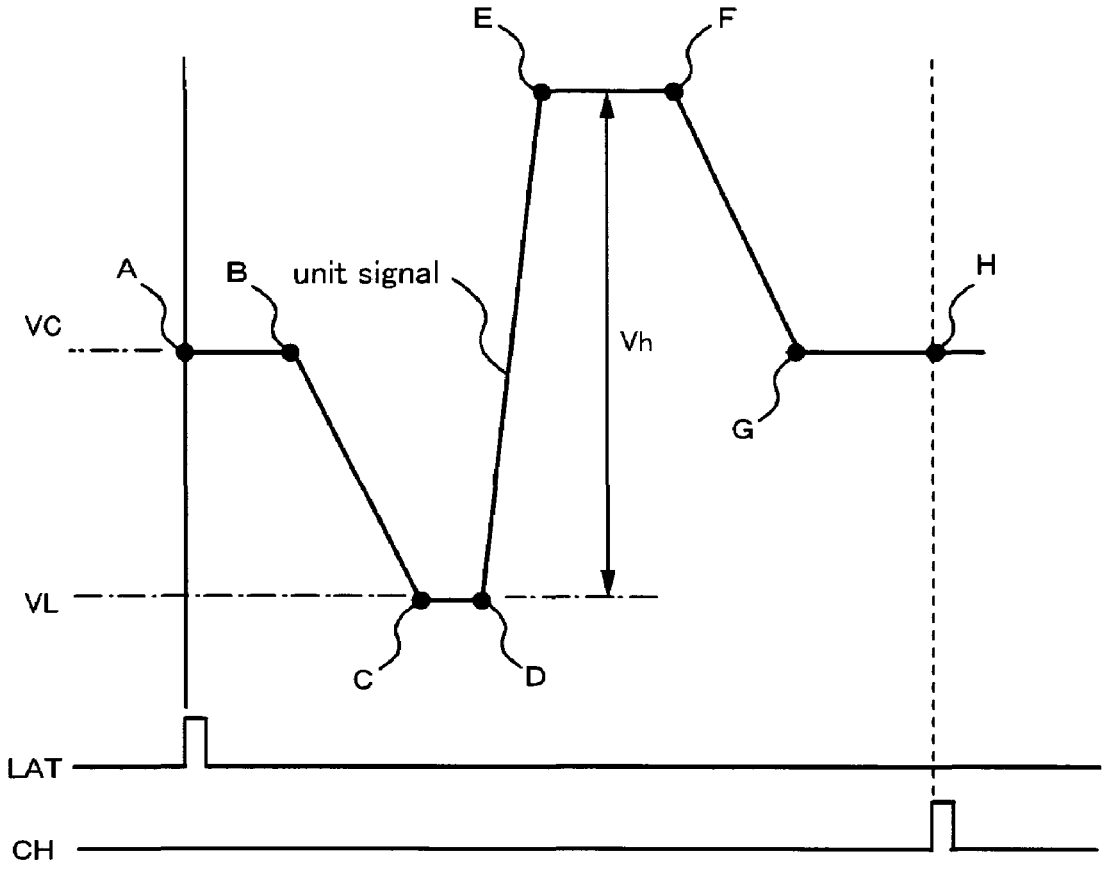
FIG. 9 is a diagram for illustrating one example of an ideal unit signal generated in an original drive signal for causing ink ejection.

FIG. 9 is a diagram for describing an example of an ideal unit signal generated in the original drive signal for causing ink ejection. FIG. 10 is a diagram for describing the concept of information stored in the memory 63 as information for generating the unit signal shown in FIG. 9.

As shown in FIG. 10, the memory 63 stores, as information for generating a unit signal, the voltage values between points A and B, C and D, E and F, and G and H in the waveform of the unit signal shown in FIG. 9, the time between points A and B, B and C, C and D, D and E, E and F, and F and G, the maximum amplitude Vh, and the minimum voltage VL. The voltage values between points A and B, C and D, E and F, and G and H are shown as a function based on the maximum amplitude Vh. For example, the voltage between points A and B and points G and H is indicated as "Vh×0.4+VL," the voltage between points C and D is "Vh×0+VL," and the voltage between points E and F is "Vh×1+VL." The time between the points of time, which is stored as time information, is indicated by the number of clocks counted between the points of time. In other words, if "36 V" is stored as the maximum amplitude Vh and "1.4 V" as the minimum voltage VL, then the voltage will be held at "15.8 V" for four clocks between points A and B, and the voltage will be changed from "15.8 V" to "1.4 V" in four clocks between points B and C, then the voltage will be held at "1.4 V" for two clocks between points C and D, and the voltage will be changed from "1.4 V" to "37.4 V" in three clocks between points D and E, then the voltage will be held at "37.4 V" for three clocks between points E and F, and the voltage will be changed from "37.4 V" to "15.8 V" in six clocks between points F and G, and after point G, the voltage will be held at "15.8 V" until the CH signal is input. In other words, point H indicates the point at which the CH_A (CH_B) signal is input. The ideal unit signal shown in FIG. 9 is a signal designed for ejecting a predetermined amount of ink, and each piezo element 417 ejects ink by being charged and discharged based on such a unit signal.

Figure 12:
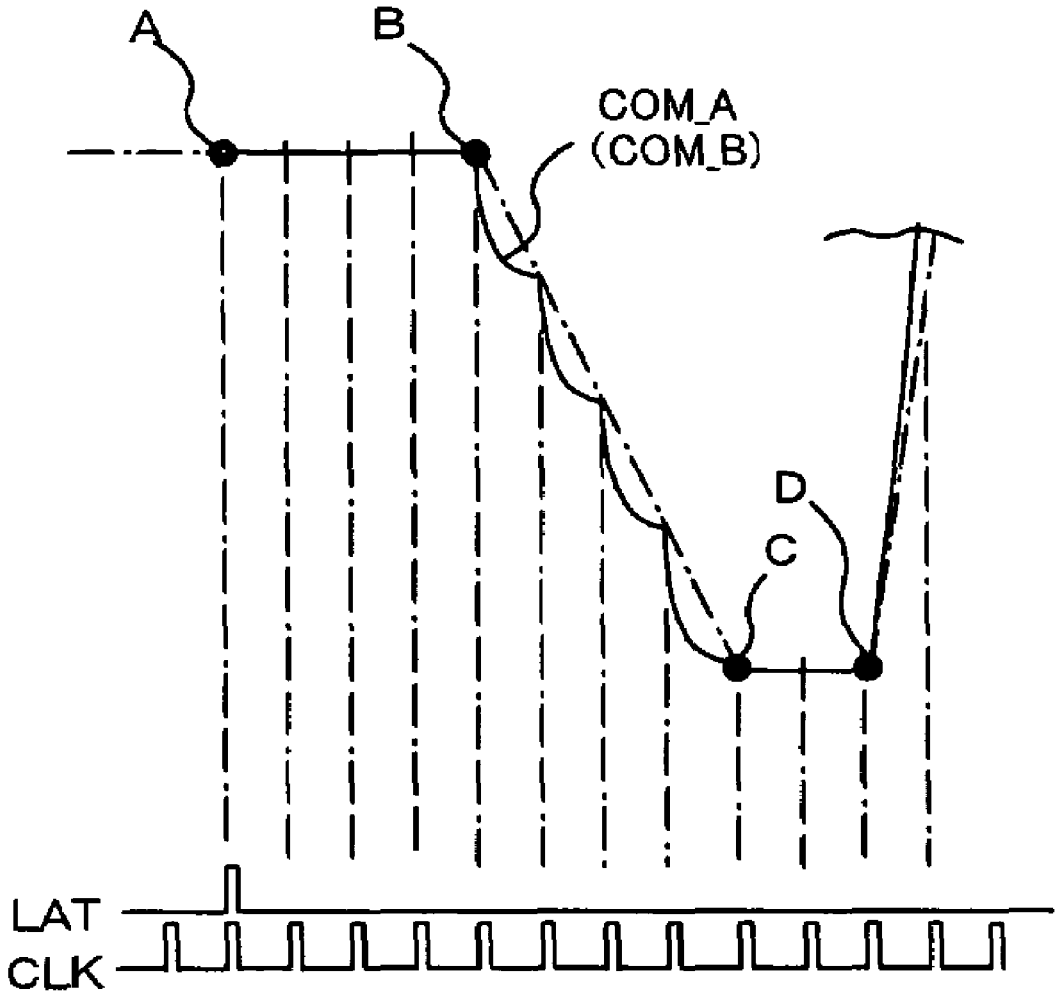
FIG. 12 is a diagram describing operation of the first waveform generating circuit 71A.

The CPU 62 on the printer-side controller 60 generates a data table showing DAC values that are input to the digital-analog converter 715A (715B) in synchronization with the clock signal based on the signal defining information (FIG. 10) for generating the kind of unit signal shown in FIG. 9. In other words, the DAC values are numerical information which is input periodically. FIG. 11 is a diagram which shows an example of a data table in which addresses are associated with DAC values input in synchronization with the clock signal CLK in order to generate unit signals. FIG. 12 is a diagram for describing the operation of the first waveform generating circuit 71A.

The DAC values which are output sequentially according to the clock signal are associated with addresses and stored in a predetermined region in the memory 63. For example, between points A and B of the original drive signal shown in FIG. 12, the DAC value "168h" associated with the output voltage "15.8 V" is output in synchronization with the clock signal CLK until the fourth clock including a latch signal LAT, which is used as a trigger, to be described below. For this reason, "168h" is stored in addresses 0 to 3. The voltage is changed in a stepwise fashion so that the output voltage reaches "1.4 V" in the four clocks from the next fifth clock through the eighth clock. In other words, the DAC values are set so that: at the fifth clock from the latch signal LAT, the DAC value "10Eh" which is associated with the output voltage "12.2 V" is output; at the sixth clock, the DAC value "0B4h" which is associated with the output voltage "8.6 V" is output; at the seventh clock, the DAC value "05Ah" which is associated with the output voltage "5 V" is output; and at the eighth clock, the DAC value "000h" which is associated with the output voltage "1.4 V" is output. In this way, the DAC values, which are to be output every time a clock signal CLK is input, are associated with addresses and stored sequentially in the memory 63, thus forming the data table.

The CPU 62 in the printer-side controller 60 first moves a pointer, which points to addresses in the memory 63, to address 0 in the data table based on the latch signal LAT, and outputs the DAC value stored in address 0 to the digital-analog converter 715A. Thereafter, the CPU 62 moves the pointer in sequence every time the clock signal CLK is input, as well as outputs the DAC values stored in the addresses pointed by the pointer to the digital-analog converter 715A on the first waveform generating circuit 71A. The signal generated by the operation of the first waveform generating circuit 71A based on the DAC values which have been set is amplified by the voltage amplifying circuit 716A and the first current amplifying circuit 72A, thereby generating the first original drive signal waveform.

Figure 13:
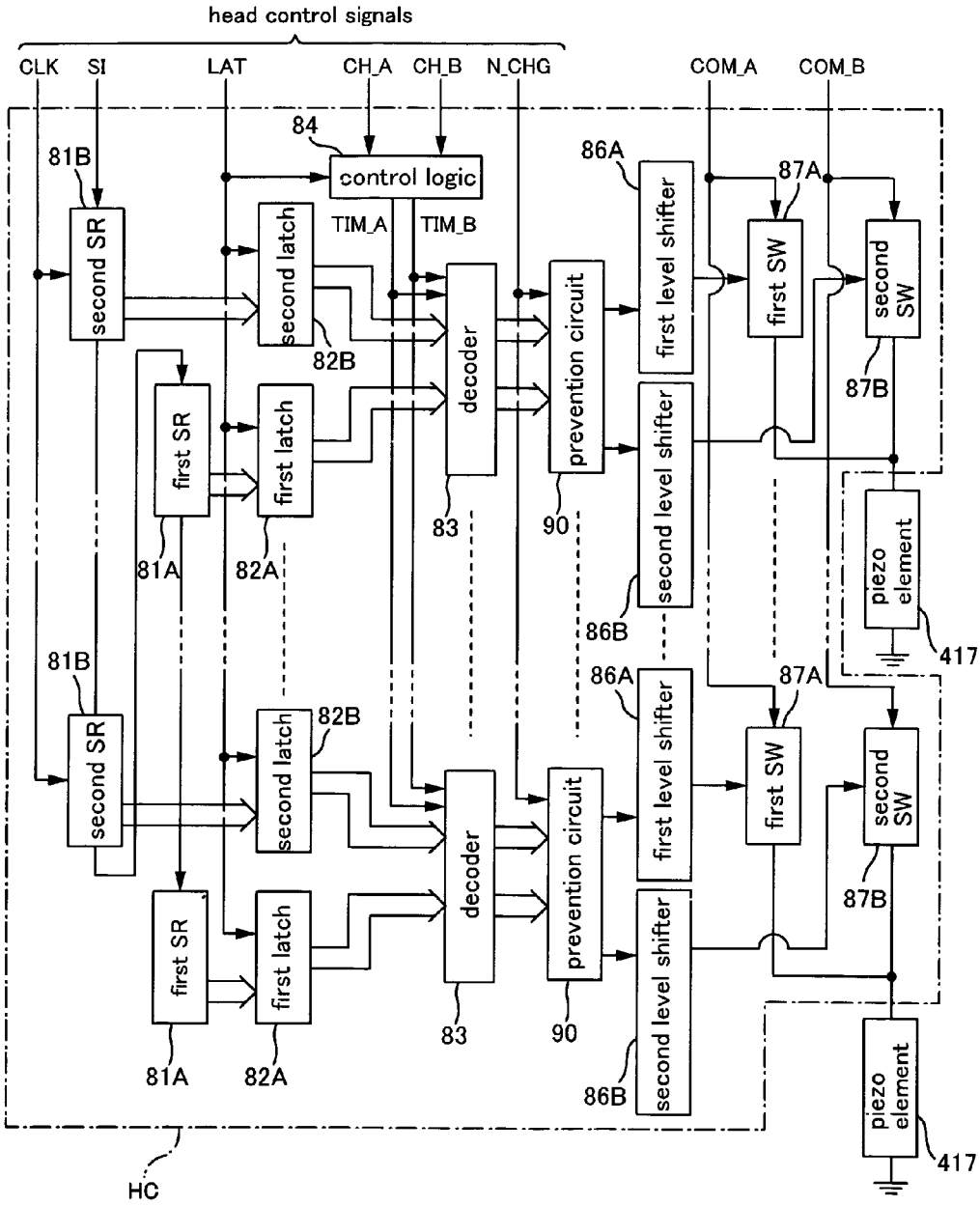
FIG. 13 is a block diagram describing a configuration of a head controller HC.

Next follows a description of the head controller HC. FIG. 13 is a block diagram describing a configuration of the head controller HC. As shown in FIG. 13, the head controller HC is provided with first shift registers 81A, second shift registers 81B, first latch circuits 82A, second latch circuits 82B, decoders 83, a control logic 84, prevention circuits 90, first level shifters 86A, second level shifters 86B, first switches 87A, and second switches 87B. All sections except for the control logic 84, i.e., the first shift register 81A, the second shift register 81B, the first latch circuit 82A, the second latch circuit 82B, the decoder 83, the prevention circuit 90, the first level shifter 86A, the second level shifter 86B, the first switch 87A, and the second switch 87B, are provided for each piezo element 417. The piezo elements 417 are provided for each nozzle Nz from which ink is ejected, so these sections are also provided for each nozzle Nz.

The head controller HC performs control for ejecting ink based on the print data (the pixel data SI) from the printer-side controller 60. In the present embodiment, the pixel data comprises two bits, and this pixel data is sent to the recording head 41 in synchronization with the clock signal CLK. This pixel data is sent in sequence from the high-order bit group to the low-order bit group. For example, the pixel data is sent in the following sequence: the high-order bit of nozzle Nz (#1), the high-order bit of nozzle Nz (#2), . . . , the high-order bit of nozzle Nz (#179), the high-order bit of nozzle Nz (#180), the low-order bit of nozzle Nz (#1), the low-order bit of nozzle Nz (#2), . . . , the low-order bit of nozzle Nz (#179), the low-order bit of nozzle Nz (#180). For this reason, the high-order bit group of the pixel data is set in the second shift register 81B. When the high-order bit group of the pixel data for all the nozzles Nz is set in the second shift register 81B, next the low-order bit group of the pixel data for all the nozzles Nz is set in the second shift register 81B. Concomitant with setting the low-order bit group of the pixel data, the high-order bit group of the pixel data is shifted and set in the first shift register 81A.

The first shift register 81A is electrically connected to the first latch circuit 82A, and the second shift register 81B is electrically connected to the second latch circuit 82B. When the latch signal LAT from the printer-side controller 60 switches to high level, i.e., when a latch pulse is input to the first latch circuit 82A and the second latch circuit 82B, the first latch circuit 82A latches the high-order bit of the pixel data and the second latch circuit 82B latches the low-order bit of the pixel data. The pixel data which is latched by the first latch circuit 82A and the second latch circuit 82B (the pair of high-order bit and low-order bit) is input to the decoder 83. The latch signal LAT described here is also the latch signal LAT used as a trigger when generating the original drive signal.

The decoder 83 performs decoding based on the high-order bits and the low-order bits of the pixel data, configures a first drive signal COM_A and a second drive signal COM_B, and generates selection data for selecting waveform portions SS11 to SS16 and SS21 to SS26 (see FIG. 14; described below) which include the unit signals. Here, the waveform portions SS11 to SS26 indicate the overall waveform generated within times t1 to t6. The unit signal is a signal from point B to point G in FIG. 9, defining the start and the end of the operation of each piezo element 417, i.e., the points at which the voltage changes in order to cause the piezo element 417 to execute the operation of ejecting ink.

The selection data in the present embodiment is generated separately for the first original drive signal COM_A and the second original drive signal COM_B. In other words, first selection data corresponds to the first original drive signal COM_A, and is composed of six bits of data corresponding to the first waveform portion SS11 through the sixth waveform portion SS16, respectively. Similarly, second selection data corresponds to the second original drive signal COM_B, and is composed of six bits of data corresponding to the first waveform portion SS21 through the sixth waveform portion SS26, respectively. The decoder 83, which performs these operations, corresponds to a "selection data generating section", and generates six-bit selection data from the two-bit pixel data (gradation data) of a number corresponding to the number of original drive signals COM_N.

Figure 14:
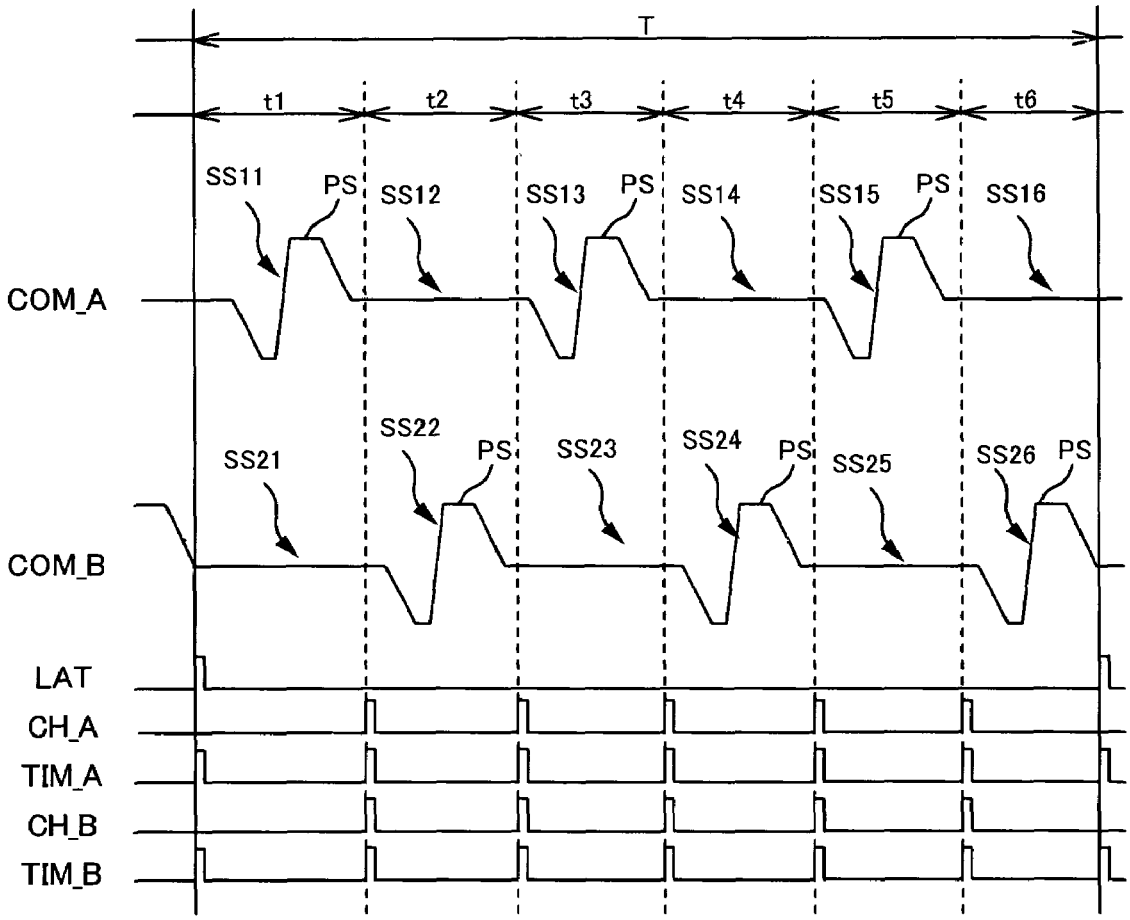
FIG. 14 is a diagram describing a first original drive signal COM_A, a second original drive signal COM_B, and a control signal.

A timing signal is input to the decoder 83 from the control logic 84. The control logic 84 functions as a timing signal generating section together with the printer-side controller 60, generating a timing signal based on the latch signal LAT and the change signals CH_A and CH_B. The timing signal is also generated separately for every original drive signal COM_N. In other words, a first timing signal TIM_A for the first original drive signal COM_A and a second timing signal TIM_B for the second original drive signal COM_B are generated. As shown in FIG. 14, in the first timing signal TIM_A, timing pulses are generated in synchronization with the timing at which the latch pulses and the change pulses for the first original drive signal COM_A are generated. In the second timing signal TIM_B, timing pulses are generated in synchronization with the timing at which the latch pulses and the change pulses for the second original drive signal COM_B are generated.

The six-bit selection data generated by the decoder 83 is output in sequence from the high-order bits at the timing specified by the timing pulse. The selection data that has been output is input to the first level shifter 86A and the second level shifter 86B after passing through the prevention circuit 90. In other words, the first selection data is input to the first level shifter 86A in synchronization with the rising edge timing of the timing pulses of the first timing signal TIM_A. Further, the second selection data is input to the second level shifter 86B in synchronization with the rising edge timing of the timing pulses of the second timing signal TIM_B.

The first level shifter 86A and the second level shifter 86B function as a voltage amplifier. In other words, when the selection data is "1", the first level shifter 86A and the second level shifter 86B output an ON signal which has been raised to a voltage at which a corresponding switch (a first switch 87A or a second switch 87B) can be driven. For example, if the first selection data is "1", an ON signal which has been raised to several tens of volts is output to the first switch 87A. Similarly, if the second selection data is "1", an ON signal which has been raised to several tens of volts is output to the second switch 87B.

Note that in the present embodiment, a prevention circuit 90 is arranged between the decoder 83 on the one hand and the first level shifter 86A and the second level shifter 86B on the other. The prevention circuit 90 prevents both the first original drive signal COM_A and the second original drive signal COM_B from being applied simultaneously to one piezo element 417. The prevention circuit 90 is configured by a logic circuit, for example.

From the original drive signal generating circuit 70, the first original drive signal COM_A is applied to the input side of the first switch 87A, while the second original drive signal COM_B is applied to the input side of the second switch 87B. A piezo element 417 is electrically connected to the common output side of the first switch 87A and the second switch 87B. The first switch 87A and the second switch 87B are switches which are provided for every original drive signal COM_N to be generated. The waveform portions SS11 through SS16, which compose the first original drive signal COM_A, and the waveform portions SS21 through SS26, which compose the second original drive signal COM_B are selectively applied to each piezo element 417.

The selection data controls operation of the first switch 87A and the second switch 87B. In other words, while the selection data input to the first switch 87A is "1", the first switch 87A is in a connectable state, and the first original drive signal COM_A is applied to the piezo element 417. Similarly, while the selection data input to the second switch 87B is "1", the second original drive signal COM_B is applied to the piezo element 417. The voltage of the piezo element 417 is determined according to the first original drive signal COM_A or the second original drive signal COM_B, which has been applied. However, while the selection data which has been input to the first switch 87A and the selection data which has been input to the second switch 87B are both "0", no electric signal for operating the first switch 87A and the second switch 87B is output from the first level shifter 86A nor the second level shifter 86B. In other words, a single drive signal COM is generated by switching between first original drive signal COM_A and the second original drive signal COM_B at a timing other than their unit signals, by either outputting an ON signal from either the first switch 87A or the second switch 87B, or not outputting an ON signal at all. The piezo elements 417 act as capacitors at this time, functioning to maintain the voltage from immediately before stoppage of application of the drive signal COM, in case application of the drive signal COM is stopped. Accordingly, while application of the drive signal COM is stopped, the piezo elements 417 maintain their deformed state from immediately before the stoppage of application of the drive signal COM, but when they are left in that state, the voltage drops through natural discharging, etc. The content of the selection data is described below in more detail.

===Specific Control When Forming Dots===

<Drive Signal COM>

FIG. 14 is a diagram describing the first original drive signal COM_A, the second original drive signal COM_B, and the control signal.

The first original drive signal COM_A shown as an example is provided with a first waveform portion SS11 which is generated during a first time period t1 of the six time periods tn of a repeating period T, a second waveform portion SS12 which is generated during a second time period t2, a third waveform portion SS13 which is generated during a third time period t3, a fourth waveform portion SS14 which is generated during a fourth time period t4, a fifth waveform portion SS15 which is generated during a fifth time period t5, and a sixth waveform portion SS16 which is generated during a sixth time period t6. Of these waveform portions, the first waveform portion SS11, the third waveform portion SS13, and the fifth waveform portion SS15 are provided with a drive pulse PS. The drive pulse PS is a waveform identical to the drive pulse PS shown in FIG. 9 and corresponds to a "unit signal". The second waveform portion SS12, the fourth waveform portion SS14, and the sixth waveform portion SS16 are located between the maximum voltage and the minimum voltage of the drive pulse PS and are constant at a reference voltage VC which acts as a standard. The reference voltage VC corresponds to the "starting voltage" and the "ending voltage" of the drive pulse PS. Accordingly, in the present embodiment, in the first original drive signal COM_A, the drive pulse PS is generated during the first time period t1 and a signal constant at the reference voltage VC (a constant voltage signal) is generated during the second time period t2. The drive pulses PS are also generated during the third time period t3 and the fifth time period t5, while the constant voltage signals are generated during the fourth time period t4 and the sixth time period t6. In other words, the first original drive signal COM_A is a signal in which the drive pulse PS and the constant voltage signal are generated in an alternating fashion.

The second original drive signal COM_B shown as an example is provided with a first waveform portion SS21 which is generated during the first time period t1, a second waveform portion SS22 which is generated during the second time period t2, a third waveform portion SS23 which is generated during the third time period t3, a fourth waveform portion SS24 which is generated during the fourth time period t4, a fifth waveform portion SS25 which is generated during the fifth time period t5, and a sixth waveform portion SS26 which is generated during the sixth time period t6. In the present embodiment, the first waveform portion SS21 through the sixth waveform portion SS26 of the second original drive signal COM_B are determined to have the same time duration as their corresponding first waveform portion SS11 through the sixth waveform portion SS16 of the first original drive signal COM_A. With this, the first change signal CH_A for the first original drive signal COM_A and the second change signal CH_B for the second original drive signal COM_B take on the H level at the same timing. Put another way, the pulses are generated in synchronization.

In the second original drive signal COM_B, the first waveform portion SS21, the third waveform portion SS23, and the fifth waveform portion SS25 are constant voltage signals which are constant at the reference voltage VC. The second waveform portion SS22, the fourth waveform portion SS24, and the sixth waveform portion SS26 are each provided with the drive pulse PS. The drive pulse PS has the same waveform as the drive pulse provided to the first original drive signal COM_A, and corresponds to an "other unit signal". The second original drive signal COM_B could be called a signal in which the constant voltage signal and the drive pulse PS are generated in an alternating fashion.

Expressed in terms of the relationship with the first original drive signal COM_A, the second original drive signal COM_B could be said to generate the drive pulse PS during the periods from the end of generation of the drive pulse PS in the first original drive signal COM_A until the start of generation of the next drive pulse PS (i.e., during the constant voltage signal generation time periods t2, t4, and t6). Similarly, expressing the first original drive signal COM_A in terms of the relationship with the second original drive signal COM_B, the first original drive signal COM_A could be called a signal which generates the drive pulse PS during the periods from the end of generation of the drive pulse PS in the second original drive signal COM_B until the start of the generation of the next drive pulse PS.

In other words, the first original drive signal COM_A and the second original drive signal COM_B could be said to be signals which generate the drive pulse PS during those periods when the complementary drive signal COM is not generating the drive pulse PS.

Incidentally, the first original drive signal COM_A and the second original drive signal COM_B are controlled to generate an identical drive pulse PS, but due to the characteristics of the original drive signal generating circuit, etc., the same voltage value may not always be achieved. Therefore, the reference voltage of the first original drive signal COM_A is called herein the "first reference voltage" and the reference voltage of the second original drive signal COM_B is called herein the "second reference voltage".

<Gradation Control>

Figures 15A, 15B:
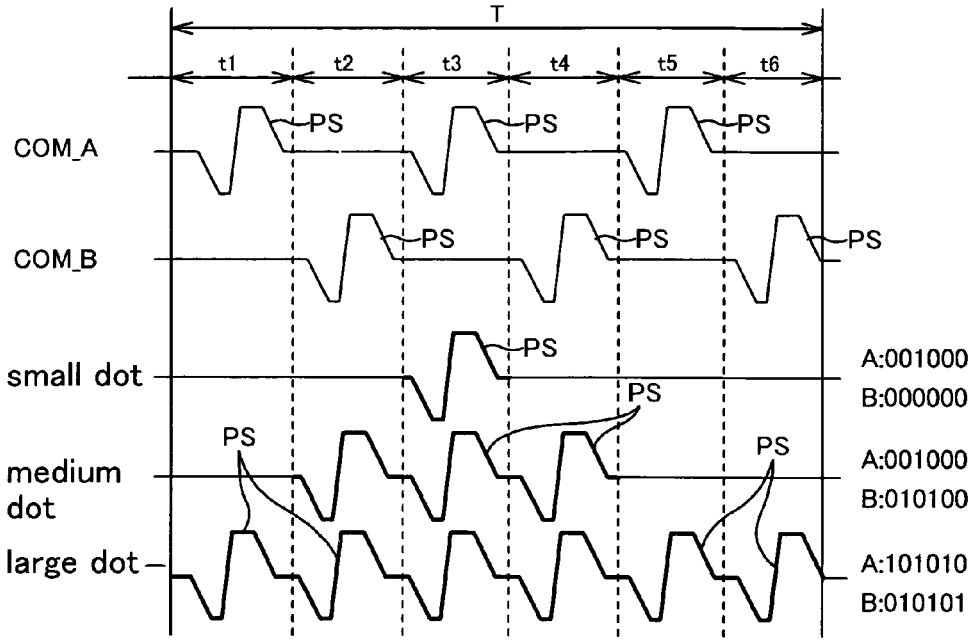
FIG. 15A is a diagram describing a waveform portion applied to piezo elements when forming a small dot, when forming a medium dot, and when forming a large dot.
FIG. 15B is a diagram describing pixel data (gradation values), selection patterns of waveform portions, and selection data.

Next, the gradation control of the printer 1 is described. Here, FIG. 15A is a diagram describing a waveform portion applied to a piezo element 417 when forming a small dot, when forming a medium dot, and when forming a large dot. FIG. 15B is a diagram describing pixel data (gradation values), selection patterns of waveform portions, and selection data. Regarding this multi-gradation control, the operations of the first switch 87A and the second switch 87B are controlled based on the selection data generated by the decoder 83. The data table shown in FIG. 15B in which the pixel data and the selection data are associated is stored in the head controller HC.

First, non-formation of a dot (pixel data "00") is described. In this case, as shown in FIG. 15B, the decoder 83 generates a first selection data "000000" and a second selection data "000000" based on the pixel data "00" which indicates no recording. The first selection data "000000" and the second selection data "000000" are output to the first switch 87A and the second switch 87B in sequence from the high-order bits at the timing when the timing signal becomes high level (rising edge timing). Here, the first selection data is "000000" and the second selection data is also "000000". For this reason, no voltage is applied to the piezo element 417 by the waveform portions SS11 through SS16 of the first original drive signal COM_A. Similarly, no voltage is applied to the piezo element 417 by the waveform portions SS21 through SS26 of the second original drive signal COM_B. As a result, no voltage is applied to the piezo element 417 and no ink is ejected from the nozzle Nz.

Next, formation of small dots (pixel data "01") is described. In this case, as shown in FIG. 15B, the decoder 83 generates a first selection data "001000" and a second selection data "000000" based on the pixel data "01" which indicates formation of a small dot. As described above, the first selection data "001000" and the second selection data "000000", are output to the first switch 87A and the second switch 87B in sequence from the high-order bits at the timing when the timing signal becomes high level. Here, the first selection data is "001000". For this reason, the first original drive signal COM_A is, as shown in FIG. 15A, applied to the piezoelement 417 during the time period t3. In other words, voltage is applied to the piezo element 417 by the third waveform portion SS13. On the other hand, the second selection data is "000000". For this reason, no voltage is applied to the piezo element 417 by the second original drive signal COM_B. Therefore, voltage is only applied to the piezo element 417 by the third waveform portion SS13 generated during the time period t3 and an amount of ink that corresponds to a small dot is ejected from the nozzle Nz. As a result, a small dot is formed on the paper S.

Next, formation of medium dots (pixel data "10") is described. In this case, as shown in FIG. 15B, the decoder 83 generates a first selection data "1001000" and a second selection data "010100" based on the pixel data "10" which indicates formation of a medium dot. When the first selection data "001000" is output to the first switch 87A, the first original drive signal COM_A is applied to the piezo element 417 during the third time period t3. In other words, as shown in FIG. 15A, voltage is applied to the piezo element 417 by the third waveform portion SS13. When the second selection data "010100" is output to the second switch 87B, the second original drive signal COM_B is applied to the piezo element 417 during the second time period t2 and the fourth time period t4. In other words, as shown in FIG. 15A, voltage is applied to the piezo element 417 by the second waveform portion SS22 and the fourth waveform portion SS24. Thus, voltage is applied to the piezo element 417 by the second waveform portion SS22 generated during the second time period t2, the third waveform portion SS13 generated during the third time period t3, and the fourth waveform portion SS24 generated during the fourth time period t4, and an amount of ink that corresponds to a medium dot is ejected from the nozzle Nz. As a result, a medium dot is formed on the paper S. When this happens, the result is that the first original drive signal COM_A and the second original drive signal COM_B are switched between the second time period t2 and the third time period t3, and between the third time period t3 and the fourth time period t4.

Next, formation of large dots (pixel data "11") is described. In this case, as shown in FIG. 15B, the decoder 83 generates a first selection data "101010" and a second selection data "010101" based on the pixel data "11" which indicates formation of a large dot. When the first selection data "1101010" is output to the first switch 87A, as shown in FIG. 15A, the first original drive signal COM_A is applied to the piezo element 417 during the first time period t1, the third time period t3, and the fifth time period t5. When the second selection data "010101" is output to the second switch 87B, as shown in FIG. 15A, the second original drive signal COM_B is applied to the piezo element 417 during the second time period t2, the fourth time period t4, and the sixth time period t6. Thus, voltage is applied to the piezo element 417 by the three waveform portions SS11, SS13, and SS15 of the first original drive signal COM_A and the three waveform portions SS22, SS24, and SS26 of the second original drive signal COM_B, and an amount of ink that corresponds to a large dot is ejected from the nozzle Nz. As a result, a large dot is formed on the paper S. When this happens, the result is that the first original drive signal COM_A and the second original drive signal COM_B are switched between the first time period t1 and the second time period t2, between the second time period t2 and the third time period t3, between the third time period t3 and the fourth time period t4, between the fourth time period t4 and the fifth time period t5, and between the fifth time period t5 and the sixth time period t6.

In this way, in the present embodiment, the waveform portions that generate the voltage applied to the piezo elements 417 are spread out between the first original drive signal COM_A and the second original drive signal COM_B. In other words, the first original drive signal COM_A and the second original drive signal COM_B are different drive signals whose timing differs in generating the drive pulses PS. By generating the drive signal COM by switching between original drive signals which have different timings for generating the drive pulses PS in this way, the intervals of the generation timings of the drive pulses PS of the first original drive signal COM_A and those of the second original drive signal COM_B can be made long. For example, it is possible to generate a drive signal by causing the drive pulse PS of the second original drive signal COM_B to be generated between the drive pulses PS of the first original drive signal COM_A. For this reason, it is possible to cause ink to be ejected from the piezo elements 417 at a high frequency while still maintaining sufficiently large intervals between generation of the drive pulses in the original drive signals. In the example of the present embodiment, the first original drive signal COM_A and the second original drive signal COM_B are each provided with three drive pulses PS during the repeating periods T, but it is possible to provide the drive signal COM with six drive pulses PS for each repeating period T. However, by providing the first original drive signal COM_A and the second original drive signal COM_B each with three drive pulses PS and leaving open the time period from the end of generation of a certain drive pulse PS until the beginning of generation of the next drive pulse PS in both the first original drive signal COM_A and the second original drive signal COM_B, it is possible to reduce heat generation in the drive signal generating circuit for generating each original drive signal and print more detailed images at higher speeds.

===Application of Drive Signal to Charge Piezo Elements===

In printers which use piezo elements, no voltage is applied to the piezo elements when no drive signal is input to the piezo elements. For this reason, when no drive signal is input, the piezo elements are discharged and the voltage drops. Incidentally, the unit signal for defining a period from the start to the end of an operation for causing a piezo element to eject ink causes the voltage to change using the predetermined reference voltage as a standard. For this reason, it is preferable for the voltage at the starting point of the unit signal to be equal to the predetermined reference voltage. However, if there is a continuous series of pixels where no dots are formed, no voltage is applied to the piezo elements during that period. For this reason, when ejecting ink the next time, i.e., when a drive signal is input to the piezo element, the voltage of that piezo element may sometimes be lower than the reference voltage. In that case, there is a possibility that the voltage will suddenly change the moment the drive signal is input. This kind of sudden change in voltage carries a possibility that ink might be ejected due to vibration of the ink held by the piezo element. For this reason, with the printer according to the present embodiment, the piezo elements 417 are charged by applying the reference voltage according to the drive signal at a predetermined timing. The process of charging the piezo elements 417 is executed based on a signal input to the prevention circuit 90.

First Embodiment

In the first embodiment, an example is described in which the piezo elements 417 are charged using, for example, an "all-on" signal (forced application signal) which causes the drive signal COM to be applied to the piezo elements 417.

Figures 16A, 16B:
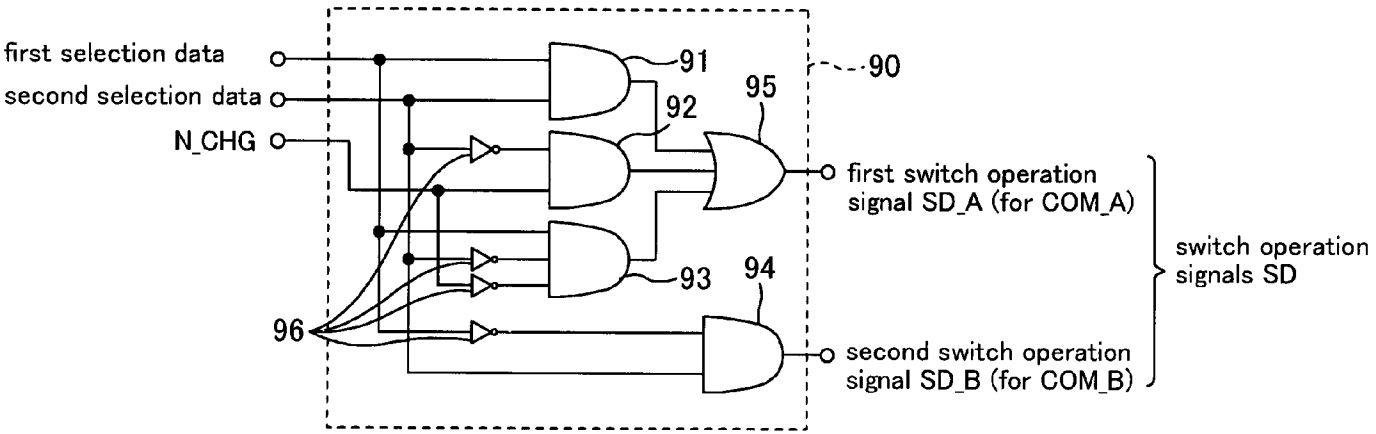
FIG. 16A is a diagram describing a prevention circuit of the present embodiment.
FIG. 16B is a truth value table for describing functions of the prevention circuit.

FIG. 16A is a diagram describing the prevention circuit 90 according to the present embodiment. FIG. 16B is a truth value table for describing functions of the prevention circuit 90.

When using the two original drive signals COM_A and COM_B, the prevention circuit 90 outputs a switch operation signal SD (a first switch operation signal SD_A and a second switch operation signal SD_B) based on the first selection data which corresponds to the first original drive signal COM_A, the second selection data which corresponds to the second original drive signal COM_B, and the "all-on" signal (forced application signal). Here, the "all-on" signal (forced application signal) is a signal which causes the switch operation signal SD for operating the first switch 87A and the second switch 87B to be output such that, when this "all-on" signal (forced application signal) is input, one selected drive signal COM is applied to the piezo elements 417, regardless of the selection data (switch control signal).

The prevention circuit 90 shown as an example is provided with three input signal wires and two output signal wires. In other words, one of the input signal wires is a signal wire for inputting the first selection data, while another input signal wire is a signal wire for inputting the second selection data. Further, the remaining input signal wire is a signal wire for inputting the "all-on" signal N_CHG. One of the output signal wires is for outputting the first switch operation signal SD_A, while the other output signal wire is for outputting the second switch operation signal SD_B.

The prevention circuit 90 according the present embodiment is provided with a first AND circuit 91, a second AND circuit 92, a third AND circuit 93, a fourth AND circuit 94, an OR circuit 95, and a plurality of inverters 96. The first selection data and the second selection data are input to the first AND circuit 91. The output of the first AND circuit 91 is output to the OR circuit 95. The "all-on" signal N_CHG and inverted data of the second selection data which has been inverted by the inverter 96 are input to the second AND circuit 92. The output of the second AND circuit 92 is also output to the OR circuit 95. The first selection data, the inverted signal of the "all-on" signal N_CHG which has been inverted by the inverter 96, and the inverted data of the second selection data which has been inverted by the inverter 96 are input to the third AND circuit 93. The output of the third AND circuit 93 is also output to the OR circuit 95. The output of the OR circuit 95 becomes the first switch operation signal SD_A. The second selection data and inverted signals of the first selection data which has been inverted by the inverter 96 are input to the fourth AND circuit 94. The output of the fourth AND circuit 94 becomes the second switch operation signal SD_B.

The prevention circuit 90 is configured such that the results of the truth value table in FIG. 16B are achieved. In other words, when the first selection data indicates connection of the first switch 87A, the prevention circuit 90 outputs the first switch operation signal SD_A for connecting the first switch 87A, regardless of the content of the second selection data or the "all-on" signal N_CHG. The prevention circuit 90 outputs a first switch operation signal SD_A for connecting the first switch 87A also when only the "all-on" signal has been output. On the other hand, when the second selection data indicates connection of the second switch 87B and the first selection data indicates non-connection of the first switch 87A, the prevention circuit 90 outputs the second switch operation signal SD_B for connecting the second switch 87B regardless of the content of the "all-on" signal N_CHG. Note that neither the first switch operation signal SD_A nor the second switch operation signal SD_B is output when the first selection data indicates non-connection of the first switch 87A, the second selection data indicates non-connection of the second switch 87B, and the "all-on" signal N_CHG has not been output.

The piezo elements 417 are charged by three of the eight signal patterns shown in FIG. 16B using the prevention circuit 90.

When the selection data (the first selection data and the second selection data) indicate application of one drive signal COM to the piezo elements 417 at the timing the "all-on" signal N_CHG is input, the prevention circuit 90 outputs a switch operation signal SD (the first switch operation signal SD_A and the second switch operation signal SD_B) such that the drive signal COM indicated by the selection data is applied to the piezo elements 417.

When the first selection data indicates application of the first drive signal COM_A during a predetermined time period, the first switch operation signal SD_A is output from the prevention circuit 90 in synchronization with the "all-on" signal N_CHG (pattern 6). When the second selection data indicates application of the second drive signal COM_B during a predetermined time period, the second switch operation signal SD_B is output from the prevention circuit 90 in synchronization with the "all-on" signal N_CHG (pattern 4).

Further, when the selection data indicates application of neither the first original drive signal COM_A nor the second original drive signal COM_B to the piezo elements 417 during a predetermined time period, the original drive signal which is input in synchronization with the "all-on" signal N_CHG is changed according to the original drive signal applied during the next time period tn.

Figure 17:
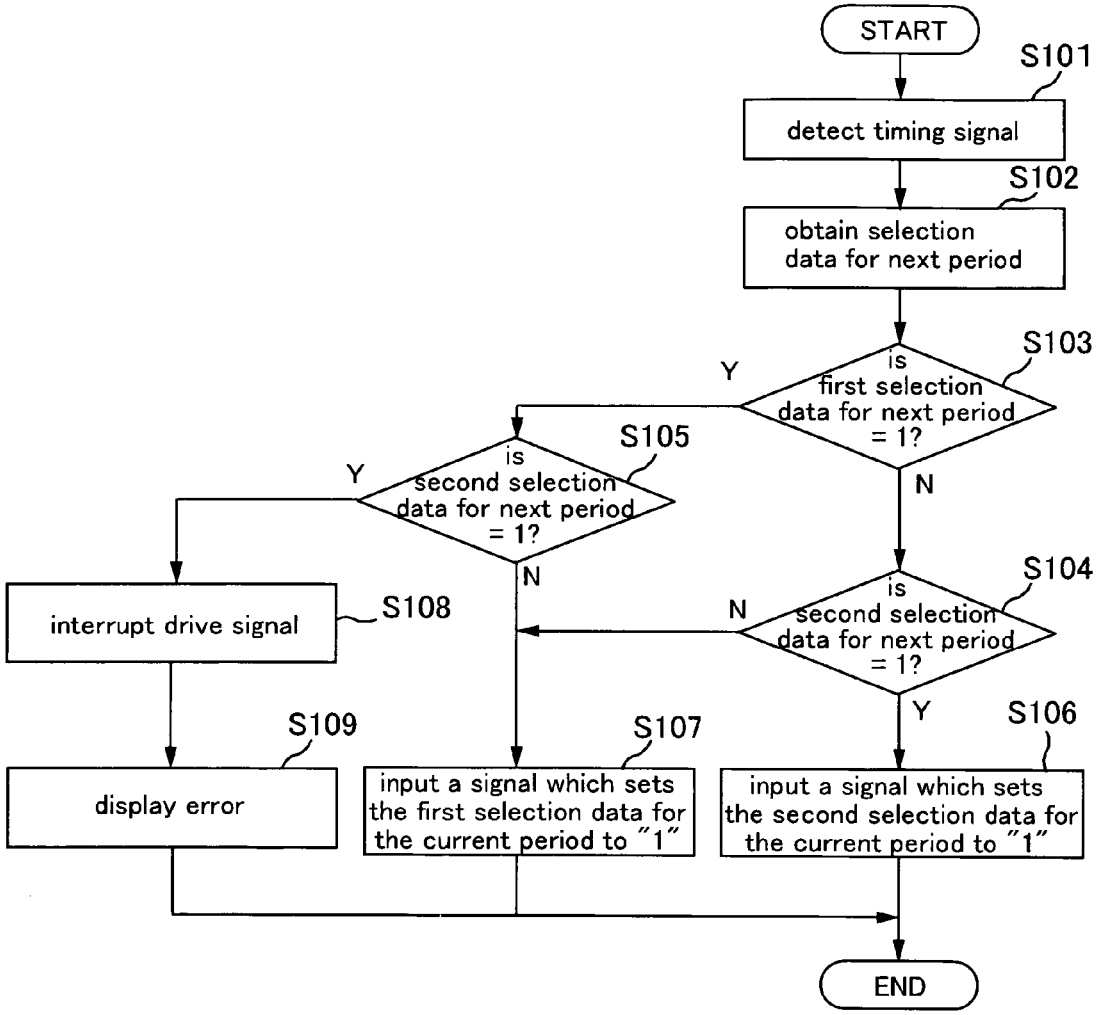
FIG. 17 is a diagram for describing the process when a drive signal COM does not indicate application to piezo elements during the predetermined time period.

FIG. 17 is a diagram for describing the process when the selection data indicates application of neither the first original drive signal COM_A nor the second original drive signal COM_B to the piezo elements 417 during the predetermined time period.

As shown in the figure, when timing signals TIM_A and TIM_B are detected (S101), the head controller HC inputs the first and second selection data to the first and second level shifters and obtains the first and second selection data for the next time period tn (S102). The head controller HC detects whether or not either of the original drive signals has been selected by the first and second selection data for the next time period tn, based on the data table in which the print data and the selection data are associated (S103 to S105). Here, if only the first selection data is "1" during the next time period tn, data is input for selecting the first original drive signal COM_A to the prevention circuit 90 in synchronization with the "all-on" signal N_CHG that is generated thereafter (S107), whereas if only the second selection data is "1" during the next time period tn, data is input for selecting the second original drive signal COM_B to the prevention circuit 90 in synchronization with the "all-on" signal N_CHG that is generated thereafter (S106). In other words, the first switch operation signal SD_A is output from the prevention circuit 90 in synchronization with the "all-on" signal N_CHG which is generated thereafter if the first selection data indicates application of the first drive signal COM_A during the next time period tn (pattern 6). On the other hand, the second switch operation signal SD_B is output from the prevention circuit 90 in synchronization with the "all-on" signal N_CHG which is generated thereafter if the second selection data indicates application of the second drive signal COM_B during the next time period tn (pattern 4).

Furthermore, if the selection data is "0" for both the first and the second selection data for the following time period tn, data for selecting the first original drive signal COM_A is input (S107), and the first switch operation signal SD_A is output from the prevention circuit 90 in synchronization with the "all-on" signal N_CHG which is generated thereafter (pattern 6). Although not theoretically possible, if the selection data for both the first and the second selection data for the following time period tn is "1" due to noise etc., application to the piezo elements 417 is interrupted (S108) and an error is displayed (S109). According to the present embodiment, if the selection data for both the first and second selection data is "0", data is input for selecting the first original drive signal COM_A. However, the data to be input may be data for selecting the second original drive signal COM_B.

The "all-on" signal N_CHG according to the present embodiment is input immediately before the timing signals TIM_A and TIM_B during each time period t1 through t6 in the repeating period T. The "all-on" signal N_CHG causes the predetermined drive signal to be output only while the ordinarily high level signal becomes the low level. Here, "immediately before" the timing signals TIM_A and TIM_B means a timing which is faster than the input timing of the timing signals TIM_A and TIM_B by the output time (2 to 4 μsec) of the "all-on" signal N_CHG, in order to input the "all-on" signal N_CHG at the end of each time period t1 through t6, or in other words, immediately before the next time period.

Figure 18:
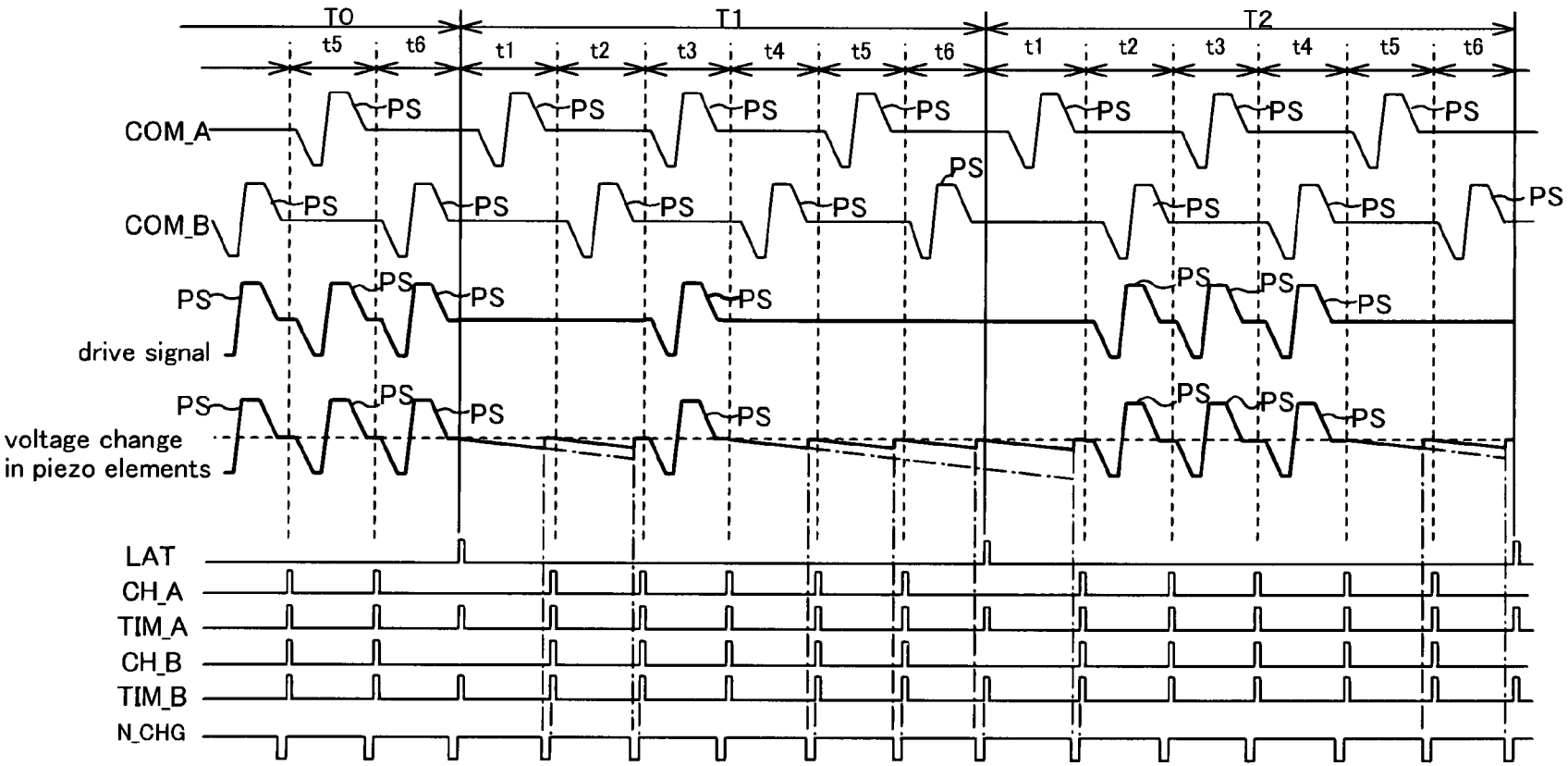
FIG. 18 is a diagram describing a method of charging piezo elements according to a first embodiment.

FIG. 18 is a diagram describing a charging method for the piezo elements in the first embodiment. FIG. 18 shows operation of a piezo element 417 which has been executed during three repeating periods T0 through T2. During the first repeating period T0, a total of six unit signals, one in each time period, are input during the six time periods t1 through t6 of the repeating period T in order to form a large dot. During the second repeating period T1, one unit signal is input during the repeating period T in order to form a small dot. During the third repeating period T2, three unit signals are input during the repeating period T in order to form a medium dot.

During the fourth time period t4 and the sixth time period t6 of the first repeating period T0, the waveform portions SS24 and SS26 of the second original drive signal COM_B are input, so that when the "all-on" signal N_CHG is input, the second original drive signal COM_B is output (pattern 4). Furthermore, during the fifth time period t5, the waveform portion SS15 of the first original drive signal COM_A is input, so that when the "all-on" signal N_CHG is input, the first original drive signal COM_A is output (pattern 6).

Next, during the first time period t1 of the second repeating period T1, neither the first original drive signal COM_A nor the second original drive signal COM_B is selected. In other words, no voltage is applied to the piezo element 417, so the piezo element is discharged and the voltage begins to drop with time. The head controller HC detects the selection data for the next time period (the second time period t2) when the timing signals TIM_A and TIM_B of the first time period are detected. In this case, neither the first original drive signal COM_A nor the second original drive signal COM_B is selected during the second time period t2. For this reason, the first switch operation signal SD_A is output based on the truth value table in FIG. 15B, and the first reference voltage of the first original drive signal COM_A is applied to the piezo element 417 (pattern 2).

Next, during the second time period t2 of the second repeating period T1, again neither the first original drive signal COM_A nor the second original drive signal COM_B is selected. For this reason, the head controller HC detects the selection data for the next time period (the third time period t3) when the timing signals TIM_A and TIM_B of the second time period are detected. In this case, the waveform portion SS13 of the first original drive signal COM_A is selected in the third time period t3. For this reason, the head controller HC inputs data for selecting the first original drive signal COM_A to the prevention circuit 90 in synchronization with the "all-on" signal N_CHG which is input immediately before the third time period t3, or in other words, immediately before the timing signals (TIM_A and TIM_B) acting as a trigger for the third time period t3. Thus, the first switch operation signal SD_A is output and the first reference voltage of the first original drive signal COM_A is applied to the piezo element 417 (pattern 6).

During the third time period t3 of the second repeating period T1, the waveform portion SS13 of the first original drive signal COM_A is input, so that data for selecting the first original drive signal COM_A is input to the prevention circuit 90 in synchronization with the "all-on" signal N_CHG which is input immediately before the timing signals (TIM_A and TIM_B) for the fourth time period t4 are input. Thus, the first switch operation signal SD_A is output and the first reference voltage of the first original drive signal COM_A is applied to the piezo element 417 (pattern 6).

From the fourth time period t4 through the sixth time period t6 of the second repeating period T1, neither the first original drive signal COM_A nor the second original drive signal COM_B is selected, and during the next time period (from the fifth time period t5 through the first time period t1 of the third repeating period T2) neither the first original drive signal COM_A nor the second original drive signal COM_B is selected. For this reason, the first switch operation signal SD_A is output in synchronization with N_CHG which is input during each of the time periods from the fourth time period t4 through the sixth time period t6 of the second repeating period T1 based on the truth value table in FIG. 15B, and the first reference voltage of the first original drive signal COM_A is applied to the piezo element 417 (pattern 2).

During the first time period t1 of the third repeating period T2, neither the first original drive signal COM_A nor the second original drive signal COM_B is selected, but during the next period (the second time period t2), the waveform portion SS22 of the second original drive signal COM_B is selected. For this reason, the head controller HC inputs data for selecting the second original drive signal COM_B to the prevention circuit 90 in synchronization with the "all-on" signal N_CHG which is input during the first time period t1 of the repeating period T2. Thus, the second switch operation signal SD_B is output and the second reference voltage of the second original drive signal COM_B is applied to the piezo element 417 (pattern 4).

During the second time period t2 of the third repeating period T2, the waveform portion SS22 of the second original drive signal COM_B is input, so that the second original drive signal COM_B is output when the "all-on" signal N_CHG is input during the second time period t2 of the repeating period T2 (pattern 4). Thereafter, during the third time period t3 of the third repeating period T2, the waveform portion SS13 of the first original drive signal COM_A is input, so that the first original drive signal COM_A is output when the "all-on" signal N_CHG is input during the third time period t3 of the repeating period T2 (pattern 6). Then, during the fourth time period t4 of the third repeating period T2, the waveform portion SS22 of the second original drive signal COM_B is input, so that the second original drive signal COM_B is output when the "all-on" signal N_CHG is input during the fourth time period t4 of the repeating period T2 (pattern 4).

In this way, when the timing signals TIM_A and TIM_B are input during a predetermined time period (the current time period) and either the first original drive signal COM_A or the second original drive signal COM_B is selected during the current time period, then the selected original drive signal is input to the piezo element 417 in synchronization with the "all-on" signal N_CHG which is input during the current time period. When neither the first original drive signal COM_A nor the second original drive signal COM_B is selected when the timing signals TIM_A and TIM_B are input during a predetermined time period (the current time period), the selection data for the following time period is detected. If, during the following time period, either the first original drive signal COM_A or the second original drive signal COM_B is selected, the original drive signal selected during the follow time period is input to the piezo element 417 in synchronization with the "all-on" signal N_CHG which is input during the current time period. Furthermore, if, during the following time period, neither the first original drive signal COM_A nor the second original drive signal COM_B is selected, then one of the original drive signals (the first original drive signal COM_A in the present embodiment) is input to the piezo element 417 in synchronization with the "all-on" signal N_CHG which is input during the current time period.

With the printer 1 according to the present embodiment, either the first reference voltage of the first original drive signal COM_A or the second reference voltage of the second original drive signal COM_B is applied to the piezo element 417 during each of the time periods t1 through t6 during each repeating period T, so that the piezo element 417 is never continuously discharged. In particular, even if a state in which dots are not formed over a plurality of pixels, or in other words, a state in which ink is not ejected continues, the reference voltage is applied to the piezo element 417 at constant intervals, and therefore, it possible to prevent the voltage of the piezo element 417 from dropping significantly. In other words, the voltage of each piezo element 417 is maintained at approximately a reference potential. For this reason, even if a drive signal for ejecting ink is input to a piezo element 417 after a state has continued in which no ink is ejected, there is no risk of a sudden change in voltage, thereby making it possible to prevent ink from being ejected in a wasteful manner.

It is also possible to apply the same reference voltage to the piezo elements 417 as the drive signal for ejecting ink, since the "all-on" signal N_CHG for applying voltage to the piezo elements 417 is input at the same timing as the reference voltage in the drive signal. In the present embodiment, the first original drive signal COM_A and the second original drive signal COM_B are used, so that if the first original drive signal COM_A is selected during a predetermined time period (the current time period), a drive signal is applied such that the piezo element 417 achieves the first reference voltage, while if the second original drive signal COM_B is selected, a drive signal is applied such that the piezo element 417 achieves the second reference voltage. In other words, depending on the original drive signal which is selected, it is possible to apply a drive signal to the piezo element 417 such that it achieves either the first reference voltage or the second reference voltage. When a plurality of original drive signals is being used, there are cases where the reference voltages are slightly different among the original drive signals due to variations in the drive signal generating circuit, etc. However, with the present embodiment, it is possible to apply a voltage corresponding to the reference voltage of each original drive signal to the piezo elements.

In the present embodiment, if neither the first nor the second original drive signal is selected during the predetermined time period (the current time period), the original drive signal that is selected in the following time period is adopted as the original drive signal which is to be applied to the piezo element 417 in synchronization with the "all-on" signal N_CHG. For this reason, when ejecting ink from the piezo element 417, it is possible to make the voltage of the piezo element 417 almost the same as the reference voltage of the drive voltage which is to be applied. Thus, it is possible to achieve a more accurate output such that the voltage for ejecting ink takes on a waveform such as the waveform portions SS11 through SS26, making it possible to eject a proper amount of ink. In particular, the timing at which the "all-on" signal N_CHG is input is set to a timing immediately before the timing signals TIM_A and TIM_B, which act as triggers during the time periods t1 through t6. Therefore, the drive signal is input immediately after the piezo element 417 has been charged in synchronization with the "all-on" signal N_CHG, making it possible to apply a more accurate drive signal to the piezo element 417.

In the present embodiment, an example was described in which, if neither the first original drive signal COM_A nor the second original drive signal COM_B is selected during each of the time periods, the original drive signal to be applied in the following time period is detected, and the detected original drive signal is applied to the piezo element 417 in synchronization with the "all-on" signal N_CHG. However, it is also possible to select an original drive signal to be applied to the piezo element by detecting the selection data for the following time period, regardless of the original drive signal that is selected for any of the time periods. However, if one of the original drive signals is selected, the piezo element maintains the reference voltage, so that even if a different original drive signal is applied next, the voltage will not change suddenly; however, the process for detecting the selection data for the next time period becomes more complex. For this reason, the original drive signal to be applied to the piezo elements is selected by detecting the selection data for the following time period only in cases where neither of the original drive signals is selected, in which case the voltage of the piezo elements 417 might fall.

In the present embodiment, an example was described in which the head controller HC executes a process for detecting the selection data for the following time period in cases where neither the first original drive signal COM_A nor the second original drive signal COM_B is selected, but this process can be executed by a logic circuit such as the prevention circuit 90, etc., by changing the configuration of the prevention circuit 90.

Second Embodiment

In the above first embodiment, an example was described in which the "all-on" signal N_CHG is used as a signal for charging the piezo elements, but in the second embodiment, twelve-bit data is adopted as the selection data generated based on the print data. Specifically, the time periods t1 through t6 of the first embodiment are each divided into two time periods by the change signals CH_A and CH_B. Then, as for one of the divided time periods, new change signals CH_Aa and CH_Ba are generated at a timing approximately 2 to 4 μsec immediately before the timing signals TIM_A and TIM_B which act as triggers for the next time period, and new time periods are set therebefore and thereafter. In other words, the time periods t1 through t6 of the first embodiment are each divided into a main time period ta before the new change signals CH_Aa and CH_Ba and a micro time period tb after the new change signals CH_Aa and CH_Ba, and the selection data is set in these. During the micro time period tb the drive signal is applied to the piezo elements 417 for charging them.

Figure 19:
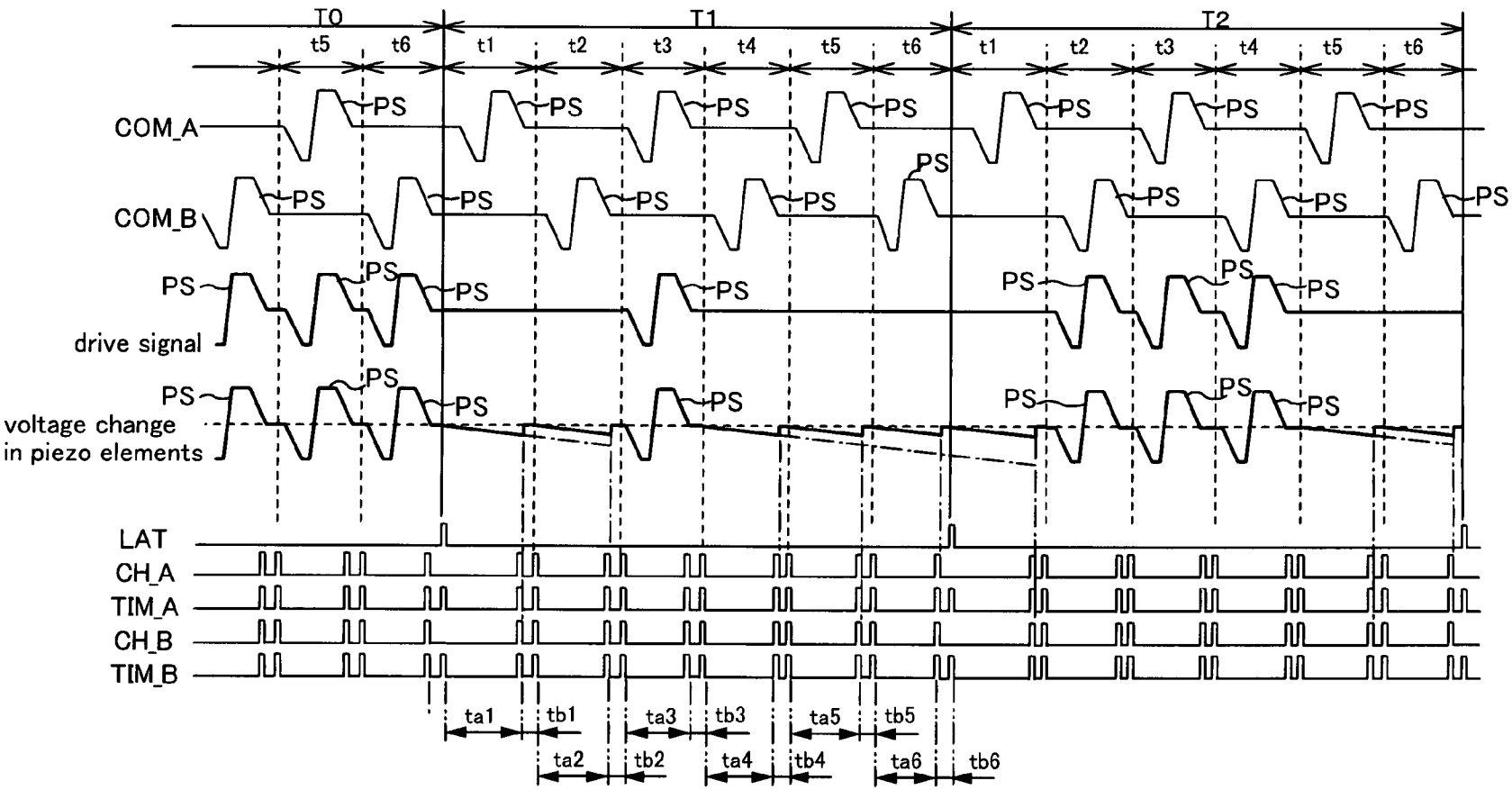
FIG. 19 is a diagram describing a method of charging piezo elements according to a second embodiment.

FIG. 19 is a diagram describing a charging method for the piezo elements in the second embodiment. FIG. 20 is a diagram describing waveform selection patterns and selection data in the second embodiment.

As shown in the figure, the repeating period T is divided into six main time periods ta1 through ta6 and six micro time periods tb1 through tb6, with the main time periods alternating with the micro time periods. The waveform portions SS11 through SS26 including the unit signals for causing ink to be ejected from the piezo elements 417 are set in the first time period t1, the third time period t3, and the fifth time period t5 for the first original drive signal COM_A, and in the second time period t2, the fourth time period t4, and the sixth time period t6 for the second original drive signal COM_B. Since it is preferable to charge the piezo elements 417 to the reference voltage before the unit signal for ejecting the ink is input to the piezo elements 417, a signal for charging the piezo elements 417 is output during the time period before the time period in which the waveform portion including the unit signal is set. For instance, when causing ink to be ejected in the second time period t2, the second original drive signal COM_B is selected, so that the selection data immediately before the second time period t2, or in other words in the micro time period tb1 of the first time period t1 is set as "1", and the piezo element 417 is charged based on this selection data. For this reason, selection data "0" is set in the micro time periods tb1, tb3, and tb5 of the first original drive signal COM_A, while selection data "1" is set in the micro time periods tb2, tb4, and tb6 of the first original drive signal COM_A. Moreover, selection data "1" is set in the micro time periods tb1, tb3, and tb5 of the second original drive signal COM_B, while selection data "0" is set in the micro time periods tb2, tb4, and tb6 of the second original drive signal COM_B. Thus, the selection data for the first original drive signal COM_A during the second repeating period T1 (form a small dot) shown in FIG. 19 is "000110010001", while the selection data for the second original drive signal COM_B is "010001000100". Moreover, the selection data for the first original drive signal COM_A during the third repeating period T2 (form a medium dot) shown in FIG. 19 is "000110010001", while the selection data for the second original drive signal COM_B is "011001100100". In other words, the "set period" which is set for charging the piezo elements 417 is the micro time period, and the selection data in the micro periods corresponds to "application information" which indicates whether or not to apply the first original drive signal and the second original drive signal.

By inputting additional new change signals CH_Aa and CH_Ba immediately before the change signals CH_A and CH_B which act as triggers to switch the signals in the time periods t1 through t6, setting the micro time periods tb1 through tb6, and allocating the selection data to those micro time periods, it becomes possible to charge the piezo elements 417 by applying the reference voltage periodically without using the "all-on" signal N_CHG.

In the present embodiment, an example was described in which micro time periods tb were set in association with all the time periods t1 through t6 of the first original drive signal COM_A and the second original drive signal COM_B, but there is no need to set them for all the time periods. For example, it is possible to set micro time periods only for the timing in which the reference voltage is to be applied during the micro time periods tb, i.e., only for the time periods t2, t4, and t6 of the first original drive signal COM_A and the time periods t1, t3, and t5 of the second original drive signal COM_B. In this case, it is possible to make the selection data nine-bit data, thereby reducing the amount of data and making it possible to reduce the communication time and the processing time.

Other Embodiments

The above embodiments primarily describe the printing system 100 provided to the printer 1, but also included is the disclosure of a printing control apparatus and a printing control method, etc. The above embodiments are for making understanding of the present invention easier, and do not limit interpretation of the present invention. The invention can of course be altered and improved without departing from the gist thereof and includes equivalents. In particular, the embodiments mentioned below are also included in the invention.

<Printing System>

Regarding a printing system, the above embodiments described a printing system 100 in which are separately configured a printer 1 as a printing apparatus and a computer 110 as a printing control apparatus, but the present invention is not limited to this configuration. The printing system may be configured such that the printing apparatus and the printing control apparatus are a single unit.

<Ink>

The above embodiments were of the printer 1, and thus a dye ink or a pigment ink was caused to be ejected from the nozzles Nz. However, the ink that is ejected from the nozzles Nz is not limited to such inks. The color of the ink is also not limited to the four colors mentioned above.

Other Examples of Applications

The printer 1 was described in the above embodiments, but the present invention is not limited to this. For example, technology like that of the present embodiment can also be applied to various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, methods therefor and manufacturing methods thereof are within the scope of application.

What is claimed is:

1. A printing method comprising:

generating a drive signal that drives a piezo element by selecting, based on print data, either a first original drive signal having a unit signal that defines the start to the end of an operation of causing said piezo element to eject ink by changing a voltage of said piezo element using a first reference voltage as a reference, said first original drive signal being generated by a first original drive signal generating section, or a second original drive signal having a unit signal that defines the start to the end of an operation of causing said piezo element to eject ink by changing the voltage of said piezo element using a second reference voltage as a reference, said second original drive signal being generated simultaneously with said first original drive signal and being generated by a second original drive signal generating section that is different from said first original drive signal generating section;

ejecting ink using said piezo element by applying the generated drive signal to said piezo element to charge and discharge said piezo element; and charging said piezo element so that the voltage of said piezo element attains either said first reference voltage or said second reference voltage during a predetermined period during which neither said first original drive signal nor said second original drive signal is selected.

2. A printing method according to claim 1, wherein said predetermined period is a period during which at least either said first original drive signal is equal to said first reference voltage or said second original drive signal is equal to said second reference voltage.

3. A printing method according to claim 1, wherein said predetermined period is a period during which said first original drive signal is equal to said first reference voltage and said second original drive signal is equal to said second reference voltage.

4. A printing method according to claim 1, wherein said piezo element is charged during said predetermined period before said unit signal in said drive signal is output.

5. A printing method according to claim 1, wherein said piezo element is charged during said predetermined period so that the voltage of said piezo element attains the reference voltage of either one of said first original drive signal and said second original drive signal which is to be selected next.

6. A printing method according to claim 1, wherein a plurality of piezo elements are provided as said piezo element; and wherein the piezo elements are charged during said predetermined period according to a charge instruction signal for charging all the piezo elements which can be driven based on said drive signal.

7. A printing method comprising:

generating a drive signal that drives a piezo element by selecting, based on print data, either a first original drive signal having a unit signal that defines the start to the end of an operation of causing said piezo element to eject ink by changing a voltage of said piezo element using a first reference voltage as a reference, said first original drive signal being generated by a first original drive signal generating section, or a second original drive signal having a unit signal that defines the start to the end of an operation of causing said piezo element to eject ink by changing the voltage of said piezo element using a second reference voltage as a reference, said second original drive signal being generated simultaneously with said first original drive signal and being generated by a second original drive signal generating section that is different from said first original drive signal generating section;

ejecting ink using said piezo element by applying the generated drive signal to said piezo element to charge and discharge said piezo element; and charging said piezo element so that the voltage of said piezo element attains either said first reference voltage or said second reference voltage during a predetermined period during which neither said first original drive signal nor said second original drive signal is selected;

wherein a plurality of piezo elements are provided as said piezo element;

wherein said predetermined period is a period during which said first original drive signal is equal to said first reference voltage and said second original drive signal is equal to said second reference voltage; and wherein said piezo element is charged according to a charge instruction signal for charging all the piezo elements which can be driven based on said drive signal during said predetermined period within a single pixel period during which ink for forming a pixel is ejected, said pixel constituting an image to be printed, before said unit signal in said drive signal is output so that the voltage of said piezo element attains the reference voltage of either one of said first original drive signal and said second original drive signal which is to be selected next.

8. A printing apparatus comprising:

a piezo element for ejecting ink by being charged and discharged;

a drive signal generating section that generates a drive signal for driving said piezo element by selecting, based on print data, either a first original drive signal having a unit signal for defining the start to the end of an operation of causing said piezo element to eject ink by changing a voltage of said piezo element using a first reference voltage as a reference, said first original drive signal being generated by a first original drive signal generating section, or a second original drive signal having a unit signal for defining the start to the end of an operation of causing said piezo element to eject ink by changing the voltage of said piezo element using a second reference voltage as a reference, said second original drive signal being generated simultaneously with said first original drive signal and being generated by a second original drive signal generating section that is different from said first original drive signal generating section; and a controller for charging said piezo element so that the voltage of said piezo element attains either said first reference voltage or said second reference voltage during a predetermined period during which neither said first original drive signal nor said second original drive signal is selected.

9. A printing system comprising:

a computer; and a printing apparatus connected to said computer and having:

a piezo element for ejecting ink by being charged and discharged;

a drive signal generating section that generates a drive signal for driving said piezo element by selecting, based on print data, either a first original drive signal having a unit signal for defining the start to the end of an operation of causing said piezo element to eject ink by changing a voltage of said piezo element using a first reference voltage as a reference, said first original drive signal being generated by a first original drive signal generating section, or a second original drive signal having a unit signal for defining the start to the end of an operation of causing said piezo element to eject ink by changing the voltage of said piezo element using a second reference voltage as a reference, said second original drive signal being generated by a second original drive signal generating section; and a controller for charging said piezo element so that the voltage of said piezo element attains either said first reference voltage or said second reference voltage during a predetermined period during which neither said first original drive signal nor said second original drive signal is selected.

10. A storage medium having recorded thereon a computer program for making a printing apparatus having a piezo element for ejecting ink by being charged and discharged, and a drive signal generating section that generates a drive signal for driving said piezo element by selecting, based on print data, either a first original drive signal having a unit signal for defining the start to the end of an operation of causing said piezo element to eject ink by changing a voltage of said piezo element using a first reference voltage as a reference, said first original drive signal being generated by a first original drive signal generating section, or a second original drive signal having a unit signal for defining the start to the end of an operation of causing said piezo element to eject ink by changing the voltage of said piezo element using a second reference voltage as a reference, said second original drive signal being generated by a second original drive signal generating section, achieve the function of charging said piezo element so that the voltage of said piezo element attains either said first reference voltage or said second reference voltage during a predetermined period during which neither said first original drive signal nor said second original drive signal is selected.

* * * * *